US006624750B1

(12) United States Patent
Marman et al.

(10) Patent No.: US 6,624,750 B1
(45) Date of Patent: Sep. 23, 2003

(54) WIRELESS HOME FIRE AND SECURITY ALARM SYSTEM

(75) Inventors: Douglas H. Marman, Ridgefield, WA (US); Kai Bang Liu, Beaverton, OR (US)

(73) Assignee: Interlogix, Inc., Tualatin, OR (US)

( * ) Notice: Subject to any disclaimer, the term of this patent is extended or adjusted under 35 U.S.C. 154(b) by 0 days.

(21) Appl. No.: 09/831,425

(22) PCT Filed: Oct. 6, 1999

(86) PCT No.: PCT/US99/23386

§ 371 (c)(1),
(2), (4) Date: May 7, 2001

(87) PCT Pub. No.: WO00/21053

PCT Pub. Date: Apr. 13, 2000

Related U.S. Application Data

(60) Provisional application No. 60/103,432, filed on Oct. 6, 1998.

(51) Int. Cl.[7] ..... G08B 29/00

(52) U.S. Cl. ..... 340/506; 340/539; 340/531; 340/825.36; 340/825.49

(58) Field of Search ..... 340/506, 539, 340/531, 825.36, 825.49, 511

(56) References Cited

U.S. PATENT DOCUMENTS

| | | | | |
|---|---|---|---|---|
| 4,363,031 A | | 12/1982 | Reinowitz | 340/539 |
| 4,559,526 A | | 12/1985 | Tani et al. | 340/539 |
| 4,641,127 A | | 2/1987 | Hogan et al. | 379/40 |
| 4,652,859 A | | 3/1987 | Van Wienen | 340/503 |
| 4,801,924 A | * | 1/1989 | Burgmann et al. | 340/521 |
| 4,812,820 A | | 3/1989 | Chatwin | 340/518 |
| 4,855,713 A | | 8/1989 | Brunius | 340/506 |
| 4,994,787 A | | 2/1991 | Kratt et al. | 340/505 |
| 5,132,968 A | | 7/1992 | Cephus | 370/94.1 |
| 5,159,315 A | | 10/1992 | Schultz et al. | 340/539 |
| 5,319,394 A | | 6/1994 | Dukek | 348/148 |

(List continued on next page.)

FOREIGN PATENT DOCUMENTS

| | | | |
|---|---|---|---|
| GB | 2222288 | 2/1990 | G08C/17/00 |
| GB | 2319373 | 5/1998 | H05Q/9/00 |
| WO | 9403881 | 2/1994 | G08B/25/10 |

OTHER PUBLICATIONS

"Security For The Future, Introducing 5804BD—Advanced two–way wireless remote technology", Advertisement, ADEMCO Group, Syosset, NY, circa 1997.

"WLS906 Photoelectric Smoke Alarm", Data Sheet, DSC Security Products, Ontario, Canada, Jan. 1998.

"Wireless, Battery–Powered Smoke Detectors", Brochure, SafeNight Technology, Inc. Roanoke, VA, 1995.

*Primary Examiner*—Daryl Pope

(74) *Attorney, Agent, or Firm*—Stoel Rivers LLP

(57) ABSTRACT

A wireless alarm system (10) employs two-way transceivers (32, 60) in a network of smoke detectors (16), a base station (12), and other sensors. A keypad (14) is not needed because the system is reset by pressing a Test/Silence button (66) built into every detector or sensor. A siren is also eliminated because a sounder (64) in every detector sounds an alarm when any sensor is triggered. This is possible because every detector includes a transceiver that can receive alarm messages from any other detector. AC power wiring is also eliminated because the base station and sensors are battery powered. Only a telephone connection (48) is needed if the system is to be monitored. In apartments or dormitory installations, smoke detectors in one apartment relay alarm messages to the next apartment, and onto the next, and so on, to a centralized base station for the entire facility. The centralized base station can be located in an apartment manager's office for immediate notification of an alarm, improper smoke detector operation, low or missing battery indications, and dirty smoke detector indications. The two-way wireless alarm system can save many lives in apartments, where smoke detectors batteries are often depleted or removed.

31 Claims, 6 Drawing Sheets

U.S. PATENT DOCUMENTS

| | | | | |
|---|---|---|---|---|
| 5,465,081 | A | 11/1995 | Todd | 340/825.05 |
| 5,486,812 | A | 1/1996 | Todd | 340/539 |
| 5,578,989 | A | 11/1996 | Pedtke | 340/539 |
| 5,587,705 | A | 12/1996 | Morris | 340/628 |
| 5,630,216 | A | 5/1997 | McEwan | 455/215 |
| 5,731,756 | A | 3/1998 | Roddy | 340/539 |
| 5,914,655 | A | 6/1999 | Clifton et al. | 340/506 |
| 5,955,946 | A | 9/1999 | Behesti et al. | 340/506 |
| 5,959,528 | A | 9/1999 | Right et al. | 340/506 |

* cited by examiner

WIRELESS HOME FIRE AND SECURITY ALARM SYSTEM

This application claims the benefit of Provisional application No. 60/103,432, filed Oct. 6, 1998.

TECHNICAL FIELD

This invention relates to fire and security alarm systems and more particularly to a wireless residential fire and security alarm system.

BACKGROUND OF THE INVENTION

Currently available wireless home fire and security alarm systems are usually part of a so-called wireless security system that requires a hardwired keypad, a base station, a hardwired siren, AC power connections, and an autodialer connection to a telephone line if the system is to be monitored. Such wireless systems actually require, therefore, considerable wiring, which makes them expensive to install and requires skilled installers.

In an effort to reduce costs and wiring, some prior workers have combined the keypad and the control panel into a single unit. However, this combination is bulky and inconvenient for wall mounting, which is required for keypad access but which renders difficult the installation of AC power, telephone, and siren wiring.

Other prior workers, in an effort to reduce manufacturing and installation costs, have further combined the siren into the keypad and the base station. However, few professional alarm installation companies will use such equipment because its security is compromised. For example, an intruder, upon hearing the siren, could simply smash the siren/keypad/base station or forcibly remove it from the wall and the alarm system and telephone autodialer dialer would be disabled. Therefore at least the autodialer needs to be separate from the keypad or siren to maintain adequate security.

Smoke detectors are key sensors in a fire alarm system. In prior wireless alarm systems, the smoke detectors are battery operated and include a small transmitter that transmits a fire alarm message to the control panel. To sound the alarm throughout the house, the control panel triggers a siren. In the frequently occurring event of a false alarm, the homeowner must use the keypad to reset the alarm and go to the location of the detector that caused the false alarm to reset the detector or place it into a "hush" mode.

Prior wireless sensors, such as intrusion sensors, transmit an alarm whenever they are tripped irrespective of whether the alarm system is armed. In kitchens and high traffic areas, such alarm transmissions can unnecessarily reduce the sensor battery life and can create signal contention problems when more than one sensor transmits at the same time. Reducing these unneeded transmissions would, therefore, be beneficial.

When the alarm system is armed and an actual alarm condition is detected, prior systems sound the alarm throughout the house with one or more sirens. Each siren requires a separate installation and is usually wired in, even in so-called wireless systems.

Because of the above-described limitation, prior wireless alarm systems are unduly complicated, especially for a typical homeowner to install or service, and do not have the benefits of typical hardwired systems. Accordingly, the full market potential of wireless home fire and security alarm systems has not been realized.

There are various U.S. patents that are potentially relevant to aspects of this invention. U.S. Pat. No. 4,363,031 for WIRELESS ALARM SYSTEM is described in the detailed description section of this application.

U.S. Pat. No. 5,686,885 describes sending a test signal along with an alarm signal from a smoke detector to differentiate a test event from an alarm condition.

U.S. Pat. No. 4,855,713 describes automatically "learning" the pre-assigned addresses in transmitters used for security systems.

U.S. Pat. No. 5,465,081 describes a wireless communication system that uses transceivers to communicate from one device to another in a loop configuration while modifying the message being sent around the loop to reduce the number of transmissions required during a supervision poll.

U.S. Pat. No. 5,486,812 describes a centralized locking system in which wireless transceivers are located in window and door locks to allow locking all doors and windows by a single transceiver based key fob button depression. If a door or window is open, the key fob is informed that complete locking cannot take place. This patent, like U.S. Pat. No. 5,465,081, describes a system in which messages are passed around a loop from one device to the next.

SUMMARY OF THE INVENTION

It is an object of this invention, therefore, to provide a low-cost, low-power, user installable, supervised alarm system that requires little or no wiring.

A wireless fire and security alarm system of this invention employs two-way transceivers in the smoke detectors, other sensors, and base station. The conventional keypad can be eliminated completely because the fire alarm system is reset by pressing a Test/Silence button built into every smoke detector or fire sensor and the security system is armed and disarmed by use of a wireless key fob sized transceiver. The separate siren is also eliminated because the siren in every smoke detector sounds an alarm throughout the building when any one of the smoke detectors detects a fire. This can be accomplished because every detector has a built-in transceiver and can, therefore, receive alarm messages from any other smoke alarm.

The AC power connection is also eliminated because the control unit is battery powered. Only a telephone wire connection is, therefore, needed for the system to be monitored. Moreover, in simple residential applications, the base station is not even needed unless centralized monitoring is required.

In multi-dwelling facilities such as apartments or college dormitories, smoke detectors in one dwelling space relay alarm conditions from dwelling space to dwelling space until reaching a centralized base station for the entire facility. This centralized base station can be located in facility manager's office for immediate notification of an alarm, improper smoke detector operation, low or missing battery indications, and dirty smoke detector indications. Such a wireless alarm system can save many lives in apartments, where smoke detectors batteries are often depleted or removed.

Another embodiment incorporates a long range wireless base station that communicates over standard cellular, GSM, or PCS type networks so that not even a telephone line connection is needed.

Further enhancements include battery conserving communications protocols, a simpler means of identifying and locating trouble conditions, an alarm verification mode for false alarms reduction, simple sensor enrolling and removing methods, and voice annunciation of fire location.

Primary features and operating modes of this invention are described below.

Automatic device addressing (enrolling) eases the addition and removal of smoke detectors, intrusion sensors, or other devices (collectively "sensors") from the alarm system. Programming is automatic, meaning that no address switches need to be set. No addresses need to be preprogrammed into device, and no address numbers need to be entered into the base station.

Enrollment is carried out by pressing an "Enroll" button on the base station, causing it to listen for new sensors. Inserting batteries into new sensors to be enrolled on the system causes the new sensor to send out a "new device" message. At this point, the sensor has no address, which marks it as a new device or one that has a previously defined "new device" message. Sensors, therefore, do not need to be uniquely preaddressed and can be generic from manufacturing. When the base station is in enroll mode and receives a new device message, the base station automatically enrolls the associated sensor into the system by downloading a house code address and a unit address to the new sensor. After the sensor is enrolled into the system, the sensor indicates enrollment by beeping its sounder, flashing its light-emitting diode ("LED"), or otherwise indicating that enrollment has been accepted.

Because sensors might lose their assigned addresses when batteries become depleted and require replacement, the following procedure eliminates confusion and automates the process. Pressing the "Enroll" button on the base station causes the base station to poll all the sensors in the system to determine which of the sensors are currently enrolled and how they are currently programmed. Then, removing the batteries from one sensor at a time, and inserting new batteries into that "new" sensor causes it to send the new device message because it has lost its addressing. When the base station receives the new device message, the base station initiates another poll of all sensors in the system. If one address is now missing, the base station assumes that the missing address is associated with the same sensor that is sending the new device message and then reloads the original address into the "new" sensor. As before, the sensor either beeps or flashes to indicate enrollment.

There are instances when devices must be removed from the system, such as when a sensor fails. If the failed sensor is not un-enrolled, the system recognizes that the failed sensor is missing and generates a continuing "RF Link" trouble message, until the failed sensor is repaired and returned to the system. When the Enroll mode is entered, the base station polls the system to determine which sensors are currently enrolled. Any nonresponding sensors are automatically removed from the current system status and are, therefore, no longer polled for supervision purposes and are unable to activate the system. In some cases, such as with security devices, to prevent unwanted tampering, entry of a security code may be required before a device can be removed from the system.

It is desirable to be able to reset a fire alarm system from any detector because false alarms are all too common. For example, cooking fumes, bathroom steam, or fireplace smoke can set off a smoke detector. In such cases, the homeowner would want to reset or silence the system as quickly as possible. U.S. Pat. No. 4,363,031 (the "031 patent") describes an unsupervised system that can reset a wireless fire alarm system from any sensor. However, the system requires two buttons, one for test and one for reset.

An improved and supervised one-button process of this invention provides each sensor with a "Test/Silence" button. If the system is in its normal non-alarm state when this button is depressed, the sensor sends a "Test" signal that signals all the sensor sounders to sound for a predetermined time and signals the base station to dial a test message to the monitoring station (if the test messages in the system are to be monitored). If the system is in an alarm condition or a test alarm condition, then pressing the Test/Silence button causes a "Silence" signal to be sent to the other sensors and the base station to silence the sounders and reset the alarm system. If the Test/Silence button is depressed during an alarm condition but before a preprogrammed autodialer delay (usually about 15 seconds), the base station is prevented from autodialing an alarm condition to the monitoring station.

Problem identification is another important consideration. In prior wireless alarm systems, a sensor having a low battery chirps its sounder and sends a trouble signal to the base station, which displays a low-battery trouble signal along with the address number of the affected sensor. Some sensors may also indicate a "dirty sensor" or an "out of sensitivity range" condition. As before, these sensors can chirp their sounders or flash LEDs, and send a message to the base station. If the sensor fails to properly communicate with the base station, in a supervised system the base station indicates a trouble condition and the address number of the affected unit. In an unsupervised system, a failure to communicate may not be detected by the system and will not, therefore, be reported.

The wireless alarm system of this invention overcomes these limitations because every sensor has a receiver and the system is supervised. When a low battery is detected by a sensor, instead of beeping, which is irritating when it occurs at night, a signal is sent to the base station, which sounds a quieter trouble sounder. Information regarding the nature of the trouble signal is retrieved by depressing a Diagnostic Mode button. A "Low Battery Detector" LED illuminates and the base station transmits a message to the appropriate sensor to sound for a predetermined time, preferably about three minutes, to identify which sensor requires fresh batteries.

U.S. Pat. No. 5,686,896 describes sending a pre-low battery report from a sensor to a central station and using a timer to delay triggering a local "low battery" alarm. The present invention, however, uses two different low battery thresholds and does not employ a preset time delay between the two different messages. Low battery signals may be sent to the base station for annunciation there rather than at the smoke detector, where it would be annoying. Locating the base station in a building manager's office or at a remote monitoring station also prevents the annoying local low battery alarm that sometimes causes renters and home owners to remove batteries. The second threshold detects when the battery is at the very end of its life and sounds the local alarm only when the battery is nearly depleted.

If the problem is a dirty detector sensor, the base station illuminates a "Detector Dirty" LED and transmits a signal to the affected sensor to sound.

If an alarm has occurred and the homeowner or the fire department needs to know which sensor originated the alarm, the same process can be used. When the base station is placed in Diagnostic Mode, a red "Alarm" LED flashes to indicate an alarm condition and sends a signal to the affected sensor to sound its sounder.

When a sensor ceases communicating with the system, it is difficult, if not impossible, to send the affected sensor a message to sound its sounder. Because the affected sensor has a transceiver, however, it can recognize that it has not been polled for a predetermined time and is unable to communicate with the system. The sensor responds by changing the flashing of its LED to a trouble pattern. This way, when the base station performs its normal hourly poll and discovers that a sensor is not responding, it illuminates an "RF Link" trouble LED alerting the homeowner to inspect each of the sensors to determine which one has its LED blinking the trouble pattern.

The alarm system of this invention provides a homeowner an ability to quickly identify and manage problems. However, the system can also be programmed so that all system trouble messages are monitored by a remote monitoring station, in which case trouble signals will be sent via the dialer rather than displayed locally.

The Consumer Product Safety Commission and the National Fire Protection Association report that approximately 30 percent of all residential smoke detectors are not operational because their batteries are dead, have not been replaced, or have been removed. To avoid this problem, supervised alarm systems monitor the operational status of sensors. However, batteries are removed mainly because of frequently occurring nuisance alarms. The above-described ability to silence the system from any detector reduces this problem. However, in a monitored system that can automatically summon fire or police services, reducing the number of false alarms is vitally important.

A false alarm reduction method commonly used in hardwired systems is referred to as alarm verification. Alarm verification has not been previously employed in wireless systems because they did not include receivers in each sensor. While the above-mentioned '031 patent describes a system capable of including a receiver in each smoke detector, it describes neither alarm verification nor system supervision capabilities. However, the alarm system of this invention provides the following alarm verification capability. When a sensor first generates an alarm signal, it sends an alarm message to the base station. If the base station is set to verify the alarm, it returns a reset message to the sensor. The base station starts a timer, and if that sensor or any other sensor in the system sends another alarm message within 60 seconds, the base station transmits a message to all sensors to sound their sounders.

There are significant benefits from having a fire alarm system in which all sensors sound when any one sensor detects an alarm condition. This feature, referred to as tandem operation, can provide up to four times more warning time in response to a fire alarm. For example, if a fire starts in a basement, a person asleep in a bedroom might not be alerted by his or her bedroom sensor sounder until it is too late to escape. For this reason, virtually all new construction codes since 1989 have required wired interconnected smoke alarm systems. Yet the vast majority of homes built prior to 1989 do not have such systems because of the wiring expense.

Prior wireless fire alarm systems that incorporate only transmitters in their sensors cannot receive messages to sound their sounders in the case of an alarm. Therefore an external siren is needed to sound a fire alarm throughout the house. The '031 patent describes a smoke detector system that includes receivers, but its protocol does not supervise each sensor. This omission prevents detection of any sensor that loses communication with the system. Accordingly, unsupervised systems are considered unreliable for use in security systems, and are even less reliable for use in fire alarm systems. Therefore, a supervised system is desirable.

This invention includes a two-way wireless alarm system in which the sensor is addressable and, therefore, can be supervised and have its sounder commanded to sound. The two-way wireless system of this invention communicates either directly to the base station or by passing messages through other sensors to the base station.

A person awakened by a fire alarm is often in a state of confusion, which can cause deadly evacuation delays. Therefore, vocal annunciation of the fire detection location is employed to evoke an efficient and appropriate response. This invention includes a smoke detector with a speaker that plays prerecorded vocal messages on command. Switches set by the homeowner during installation select an appropriate message, such as identifying on which floor the detector is being installed. Accordingly, when a fire is detected by a smoke detector installed on the first floor, the smoke detector can transmit a message to all the other smoke detectors to repeat a prerecorded vocal message such as, "Fire on First Floor."

Another advantage of this invention is that apartment or dormitory systems do not need a base station in each residence. Because each sensor includes a transceiver, a base station is required only if the system requires centralized monitoring, in which case a single base station provides the autodialer or other communication means, such as a cellular radio link. In apartments or dormitories, where living areas are close together, the two-way wireless system communicates from one living area to the next. One of the sensors is designated as a master sensor that acts as a communications hub for other sensors in that residence. The master sensor includes control functions and supervision functions, but not necessarily the autodialer or other communication means. Alarm and polling messages are transmitted from the master sensor of one residence to the master sensor in another residence, on to the next residence, and finally onto a base station, which is preferably installed in a manager's office. The base station provides the autodialer and other communications means, if monitoring is desired, or simply provides local monitoring.

This system supervises the operation of each sensor to ensure the sensors are properly powered, communicating, and not dirty. In one operational mode, a fire detected in a hallway can sound the sounders in the sensors in each residence on that floor. This alarm system provides superior monitoring and supervision of apartment and dormitory sensors and is considerably less expensive than prior systems because as few as one base station is required for an entire complex rather than one base station for each residence.

Some prior systems have tried combining the base station with the keypad, an arrangement that requires placing the keypad/base station in a central location close to telephone lines. However, the alarm system of this invention employs a supervised two-way wireless network that eliminates the need for hardwired sirens and a separate keypad. This invention allows resetting the fire alarm system from any sensor and, therefore, allows locating the base station close to existing telephone lines. Access to the base station is required only to review trouble conditions, as they arise. However, because the system can be monitored, it is possible for the monitoring center to manage these trouble problems, thus eliminating the need to display trouble conditions in the residence at all.

One embodiment of this invention employs a receiver that is enabled very briefly (one to two milliseconds every second) to reduce receiver electric current draw, thereby providing a battery life of many years. In an alternative embodiment, an ultra-low power "wake-up" receiver may be employed in each device to enable an asynchronous transceiver network that simplifies communications protocols and further reduces battery power requirements. Both embodiments eliminate the need for AC power wiring and the associated power supplies. The elimination of these extra wires simplifies and speeds installation, thereby enabling homeowners and relatively unskilled installers to install the systems. Improved fire protection is, therefore, practical in all homes including those built before 1989.

Another advantage of this invention is that all sensors sound an alarm even if a base station is damaged or non-operational. Possible causes include accidental damage, batteries depleted or removed, or wireless communications interference or blockage. In such instances, it is desirable for all sensors to sound an alarm if a fire is detected. This is possible in the alarm system of this invention because each sensor is able to confirm whether its alarm message has been received by the base station. If after repeated attempts, the base station fails to respond, the sensor automatically transmits its alarm message to the other sensors, which sound their sounders.

When prior panic buttons were pressed, the user could not be certain whether the panic message was received by the monitoring station. However, this invention may also include an emergency response button having an audible confirmation. This is possible because this invention can readily include a combination of sensor types each including built-in transceivers selected from among smoke detectors, security sensors, wireless two-way keypads, hand-held wireless key fobs, energy management devices, thermostats, meter readers, and wireless emergency panic buttons. However, the panic button of this invention includes a transceiver and a mini-sounder that beeps in response to an acknowledgment message received from the monitoring, station by way of the base station.

Additional objects and advantages of this invention will be apparent from the following detailed description of preferred embodiments thereof which proceed with reference to the accompanying drawings.

DETAILED DESCRIPTION OF PREFERRED EMBODIMENTS

Figure 1:
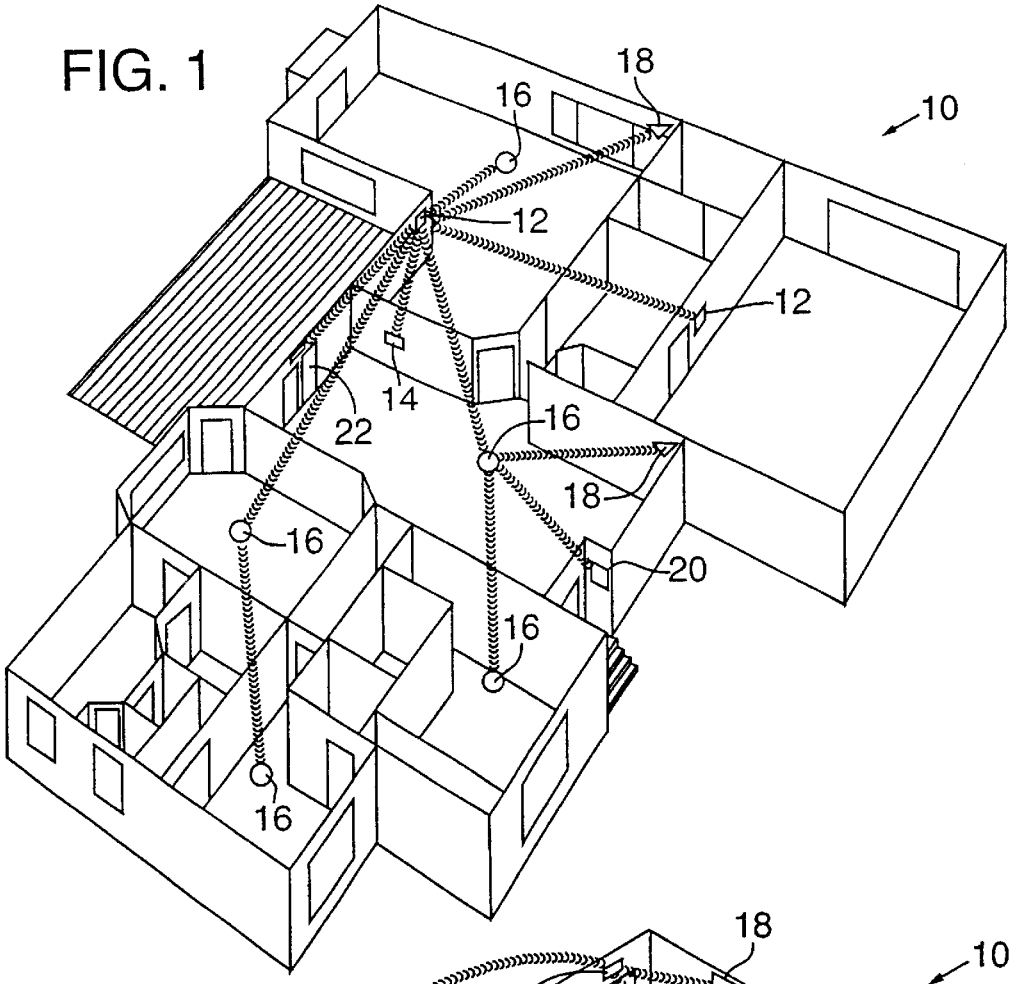
FIG. 1 is a simplified isometric pictorial view of an exemplary wireless fire and security system of this invention installed in a residence.
Figure 2:
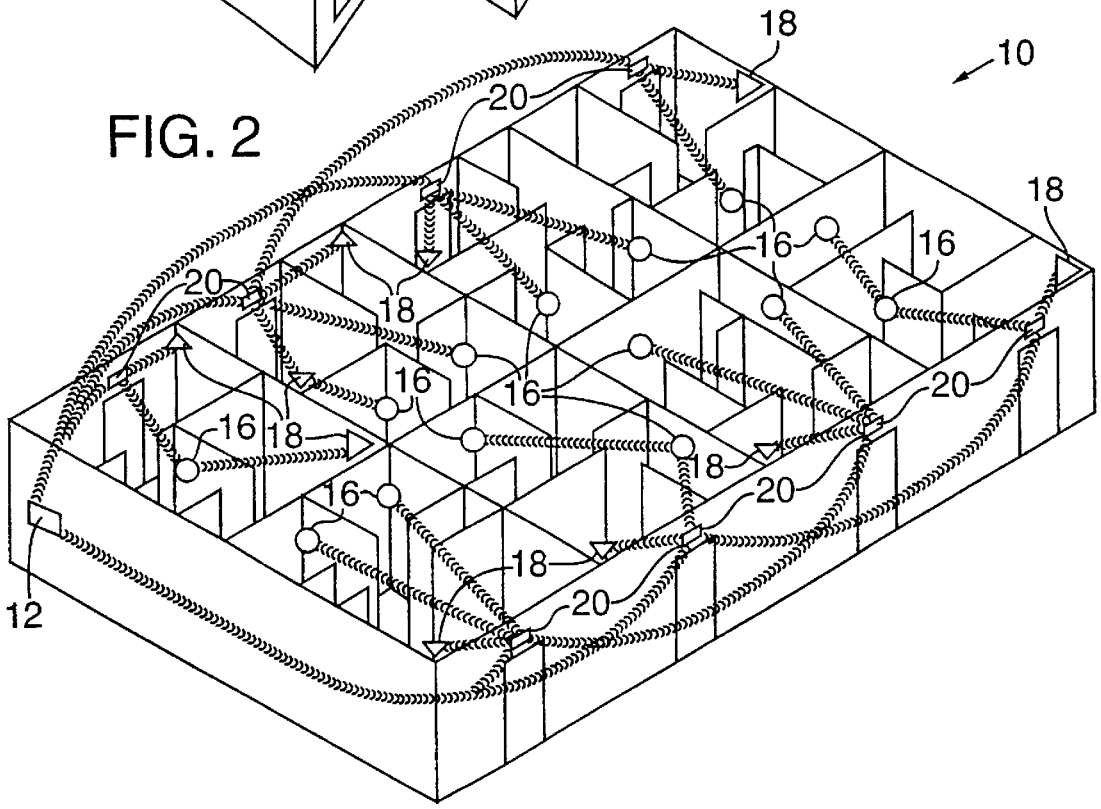
FIG. 2 is a simplified isometric pictorial view of an exemplary wireless fire and security system of this invention installed in an apartment building.

FIGS. 1 and 2 show respective home and apartment configurations of a wireless alarm system 10 including a base station 12, a keypad 14, smoke detectors 16, passive infrared ("PIR") motion detectors 18, door/window contacts with sounders 20, and a glassbreak detector 22 (collectively "sensors"). Wireless alarm system 10 may further include phone jack line seizure modules, wireless voice evacuation smoke detectors, sounders, carbon monoxide detectors, heat detectors, combination smoke and heat detectors, and personal emergency pendants.

Figure 3A:
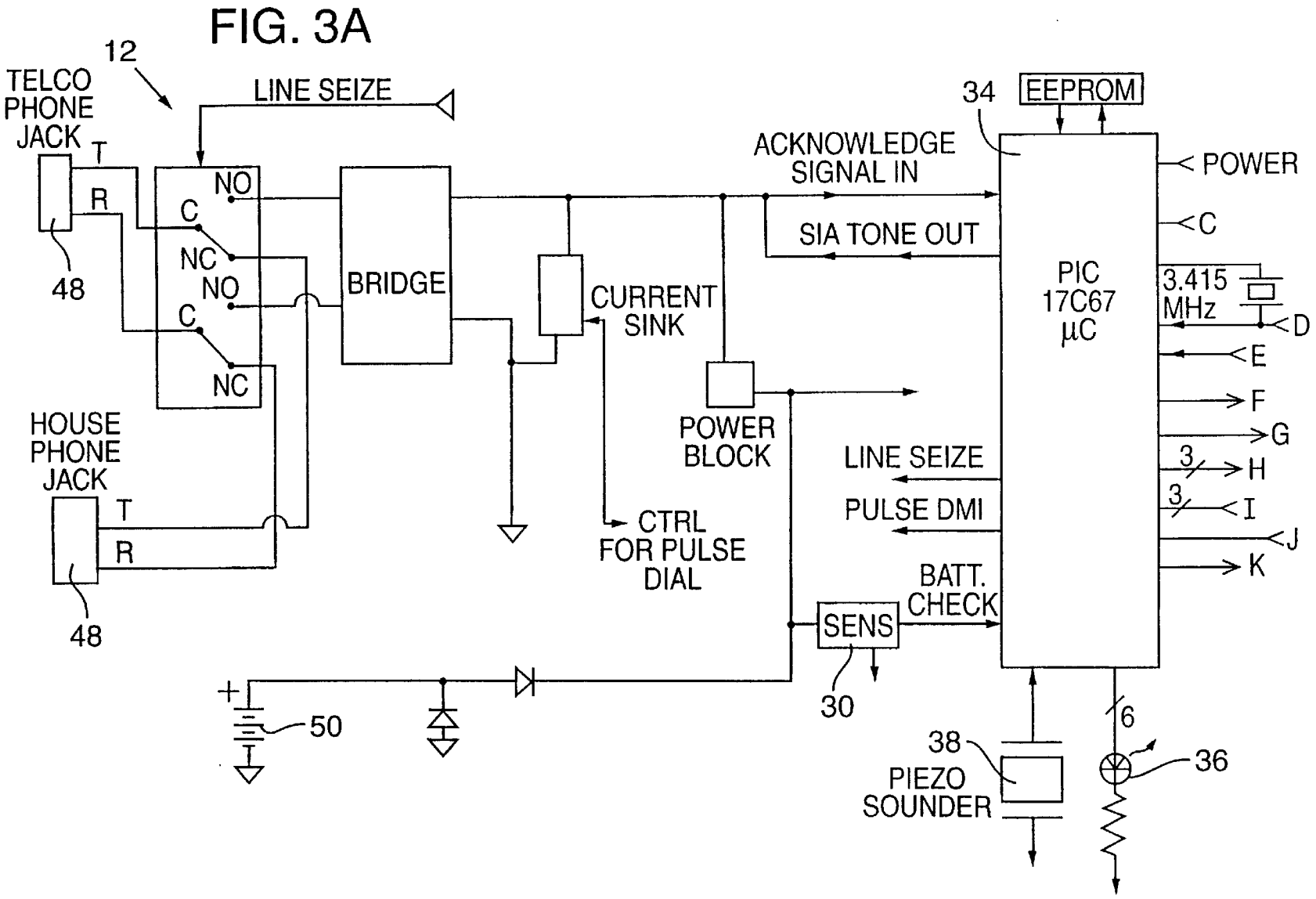
FIGS. 3A and 3B are a simplified electrical block diagram of a wireless base station of this invention.
Figure 3B:
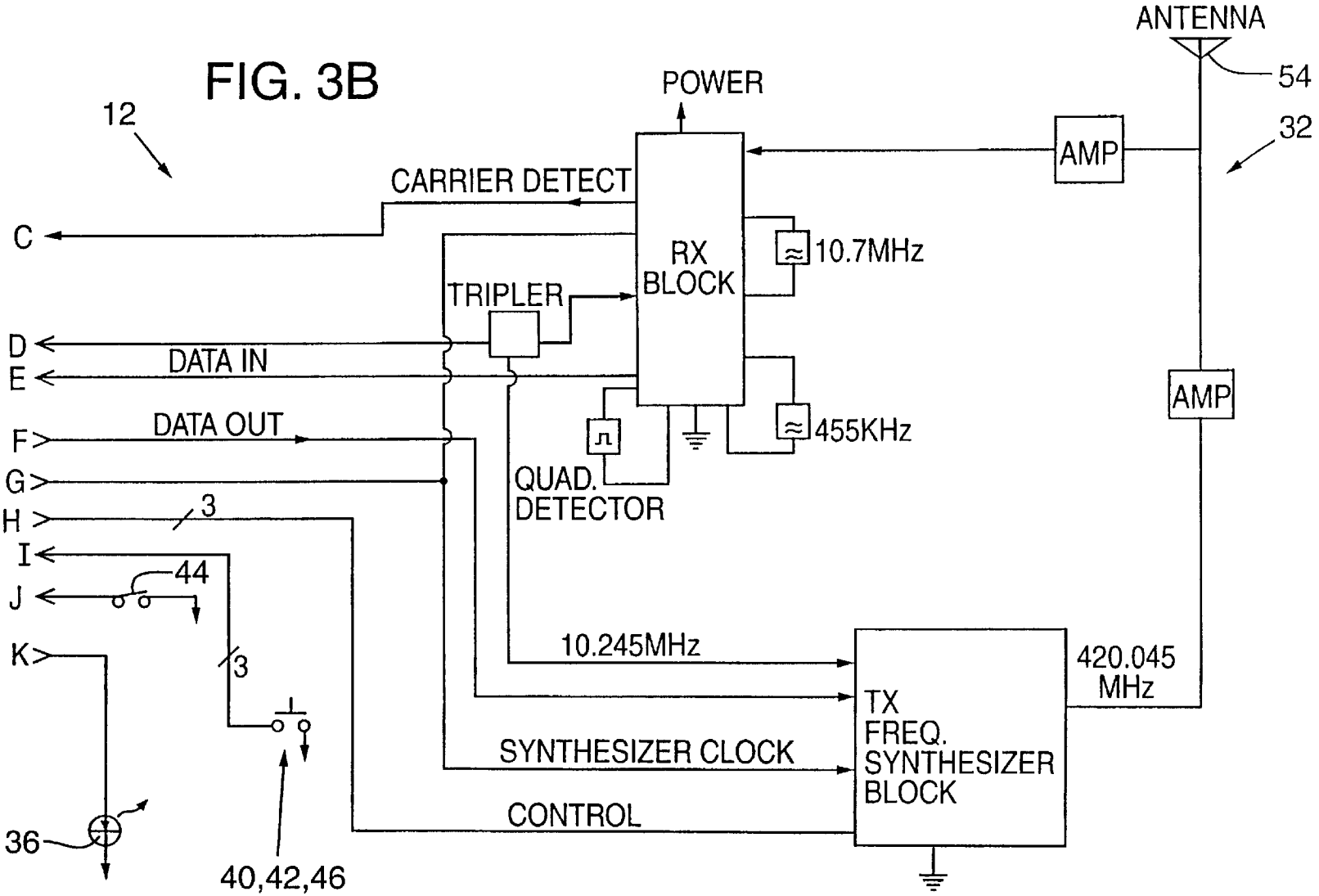
Figure 4C:
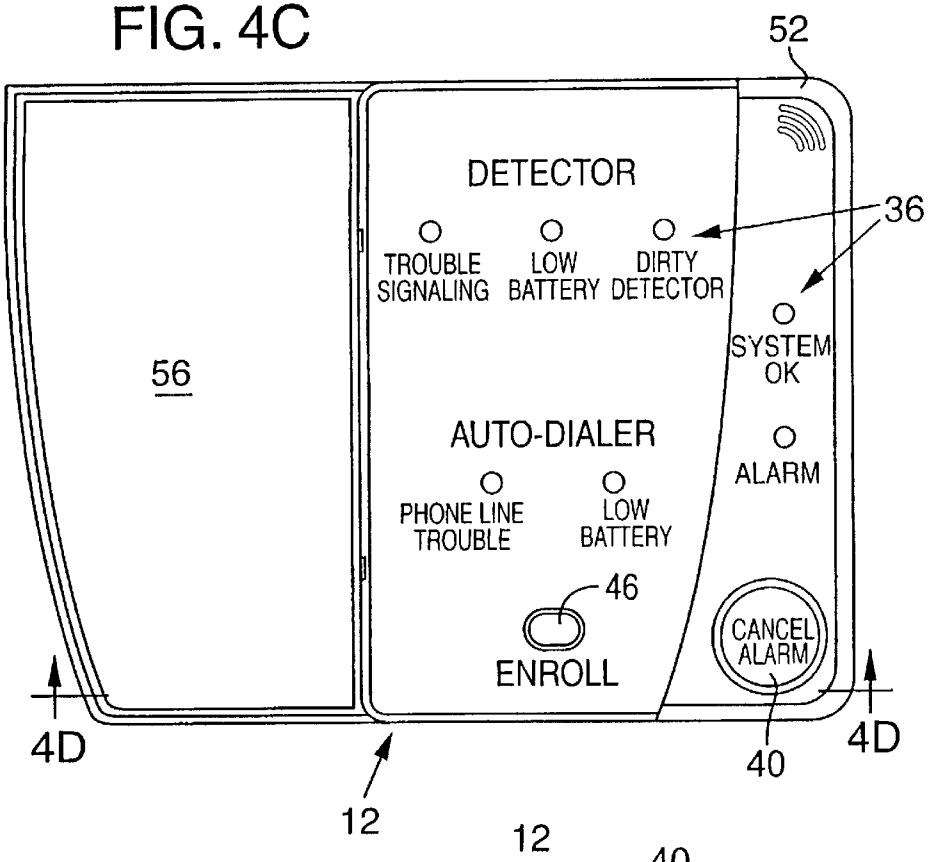
FIGS. 4A, 4B, 4C, and 4D are respective side, front (with door closed), front (with door open), and bottom cross-sectional views of a case housing the base station of FIGS. 3A and 3B.
Figure 4B:
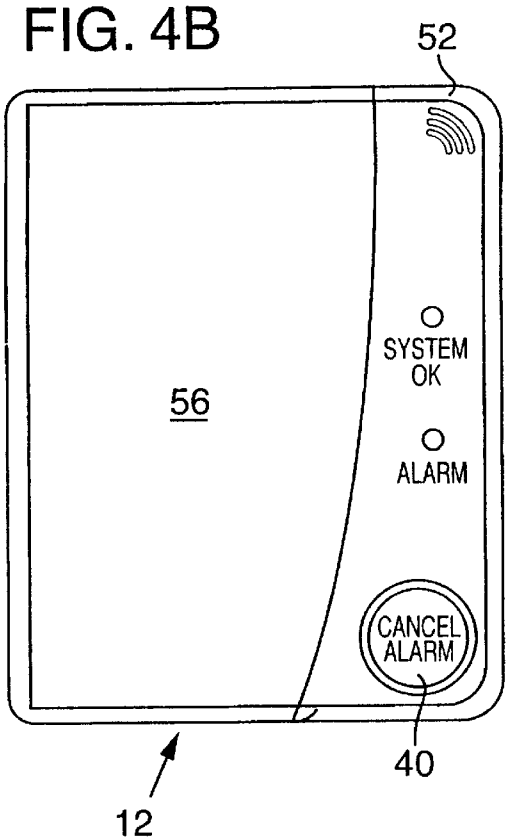
Figure 4A:
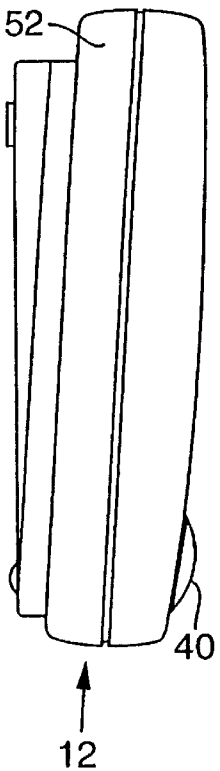
Figure 4D:
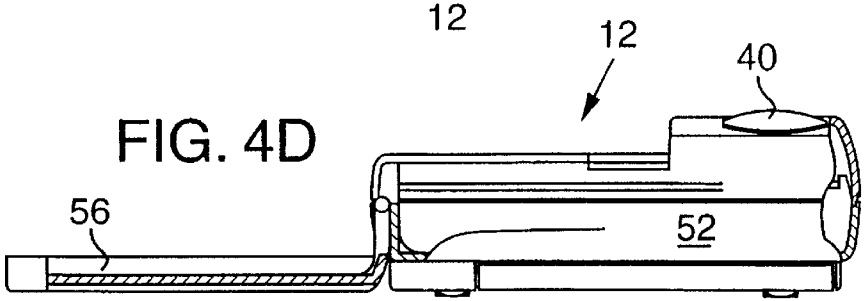

Referring to FIGS. 3 and 4, base station 12 includes a battery level sensor 30, a transceiver 32, a microprocessor 34 implementing a digital autodialer, seven diagnostic LEDs 36, a sounder 38, a large "cancel/silence" button 40, a diagnostic test button 42 (activated by opening a base station 12 door), an alarm verification switch 44, an "enroll" button 46, and two telephone connectors 48. Wireless alarm system 10 is powered by a battery 50 and employs telephone current when dialing. Battery 50 preferably comprises three user-replaceable AA batteries that are accessible in power base station 12.

Base station 12 is enclosed in a case 52 made of textured white ABS plastic including provisions for private labeling. Case 52 is slightly larger than the size of a double gang wall plate and is about 3.81 cm (1.5 in. deep). Case 52 may be wall mounted, such as over a recessed telephone jack, and includes two telephone connectors 48, one for a telephone and the other for a telephone line. Transceiver 32 is coupled to an antenna 54, both of which are housed inside case 52. Each of keypad 14, smoke detectors 16, PIR motion detectors 18, door/window contacts with sounders 20, and glassbreak detector 22 includes a transceiver, such as transceiver 32.

Case 52 includes a door 56 that conceals LEDs 36, enroll button 46, and an operating instruction label (not shown). Opening door 56 activates a diagnostic test mode of base station 12.

A battery powered base station 12 is highly desirable because it reduces costs, does not require AC power wiring and power supplies, and is easier to install. To accomplish this, base station 12 activates transceiver 32 periodically to detect incoming messages and then deactivates transceiver 32 when no messages are detected. Because security systems require rapid response, transceiver 32 activations occur at least about once per second. The receiving time period and transceiver 32 current draw are relevant parameters for reducing the resulting power consumption to a point where battery operation is practical.

Crystal controlled single frequency receivers can activate and stabilize fairly rapidly (less than 2 milliseconds) and require fairly low operating currents (less than 20 milliamps). This does not, however, enable multiple frequency reception, which is useful for avoiding environmental interference or frequency band crowding.

Frequency synthesized receivers can change operating frequencies under microprocessor control. However, such receivers require time to determine the proper frequency, load the frequency registers, and stabilize a phase-locked loop before the receiver is actually activated. Accordingly, a typical synthesized receiver can take over 4 milliseconds to load its registers and another 0.6 to 2 milliseconds to stabilize the phase-locked loop. This does not meet the requirements for battery operation.

Therefore, transceiver 32 of this invention preloads the frequency registers and stores the frequency in those registers even when the receiver is deactivated, thereby requiring only 0.6 to 2 milliseconds to detect incoming signals. Transmit frequency registers are similarly employed to conserve battery life during transmissions.

Another requirement affecting battery powered operation is the time required to successfully decode a message once it is received. In conventional systems, alarm transmissions, even if repeated eight times, take less than 0.1 second to complete. Some messages might take longer, but most alarm messages are quite short. The sensor address information consumes most of the message length. However, if the receiver is activated for only 1–2 milliseconds per second, the chances are poor of detecting a typical message.

Detecting a typical message is accomplished by transmitting a message that lasts at least as long as the time period the receiver is deactivated. The message can repeat continuously during that time period, or a preamble to the message can be transmitted during the time period. The preamble informs the receiver of an incoming message and keeps the receiver activated to receive the message at the end of the preamble. After the receiver has received the message, the receiving device communicates back to the originating device without a preamble because the originating device is already activated and awaiting a response. Therefore, once the necessary devices are activated by the first transmission, then a series of messages can be exchanged without the use of preambles. After the messages are completed and no further incoming messages are detected, the receivers return to their periodic activation cycles.

The Federal Communications Commission ("FCC") has established regulations governing alarm transmission periods, power levels, and unlicensed transmission bands. Because the regulations limit transmission time to one second, the receiver activation, detection, and deactivation period is less than a one second.

Cancel/silence button 40 is exposed on base station 12 to serve two functions. During a fire alarm condition, depressing cancel/silence button 40 resets all smoke detectors 16 and sends a restore signal to a central monitoring station. During a trouble condition, depressing cancel/silence button 40 temporarily silences sounder 38 in base station 12.

The seven diagnostic LEDs 36 annunciate the following conditions: Yellow trouble LEDs indicate "Dirty Detector," "Sensor Low Battery," "Base Low Battery," "Radio Link Trouble," and "Phone Line Trouble;" a red LED indicates "Alarm/Dialing;" and a green LED indicates "System OK."

Base station 12 enters diagnostic mode when door 56 is opened. Diagnostic mode energizes particular ones of diagnostic LE s 36 corresponding to troubles detected in alarm system 10. Base station 12 exits diagnostic mode after 10 seconds and returns to its normal operating state.

Alarm verification switch 44 is a two-position switch that is located in the battery compartment of base station 12. An "on" position activates the fire alarm verification feature, which causes base station 12 to transmit a "restore/reset" message to an initiating one of smoke detectors 16 when an initial "fire alarm" message is received. Then, if a second or subsequent fire alarm message is received from any of smoke detectors 16 within 60 seconds, base station 12 activates a fire alarm by sending a "sounder on" message to smoke detectors 16. Base station 12 waits an additional 15 seconds before dialing the central monitoring station.

Sounder 38 in base station 12 "chirps" to draw attention to trouble conditions present anywhere in alarm system 10. A short chirp interval minimizes current draw from battery 50. Chirping sounder 38 eliminates the need to chirp sounders in any of smoke detectors 16 and thereby eliminates a nighttime nuisance. Sounder 38 can be silenced by pressing cancel/silence button 40 on base station 12.

The digital autodialer implemented by microprocessor 34 dials a user programmable telephone number. During a predetermined event, the programmable telephone number is dialed and pertinent information is communicated to the central monitoring station. Preferred predetermined events include "fire alarm," fire restore," "battery low," and "test." During these predetermined events, the autodialer seizes the telephone line and communicates via the SIA-DCS protocol. The autodialer preferably stores a primary telephone number and a back-up telephone number. Base station 12 first attempts to dial the primary phone number, and after three failed attempts, it makes three attempts to dial the back-up phone number. If all attempts fail, a phone line trouble condition is indicated on one of LEDs 36.

Base station 12 of this invention will remain fully functional for at least 30 days and sounder 38 will operate for at least 10 days after a low battery condition is detected. Battery 50 has an operating life of about two to three years and reaches a low condition when it is depleted to approximately 2.7 volts.

Figure 5A:
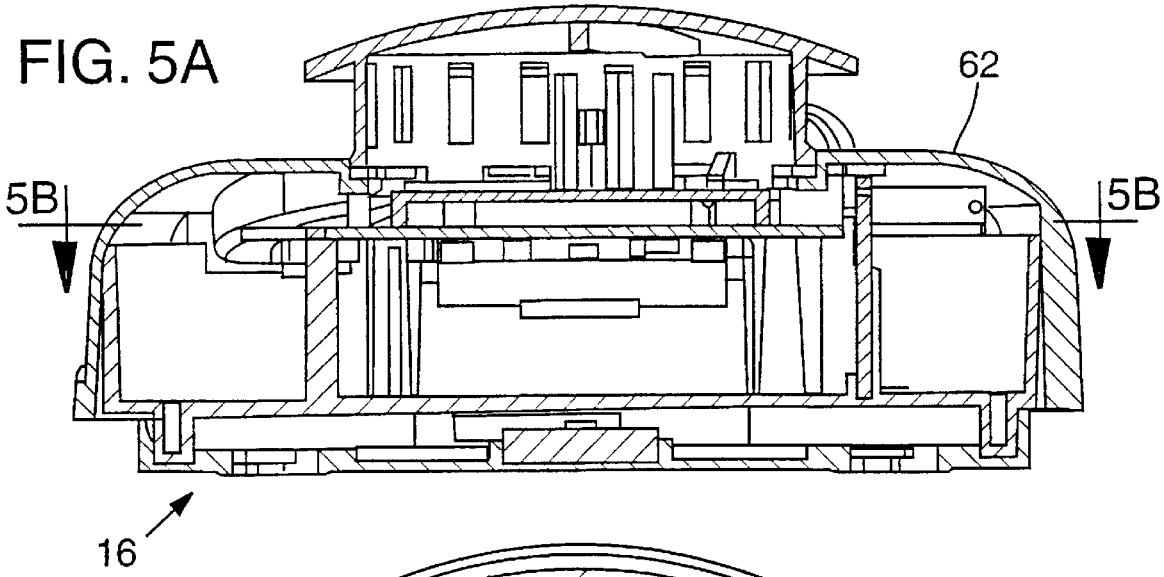
FIGS. 5A and 5B are respective sectional side and top pictorial views of a wireless smoke detector of this invention showing a preferred transceiver board mounting location.
Figure 5B:
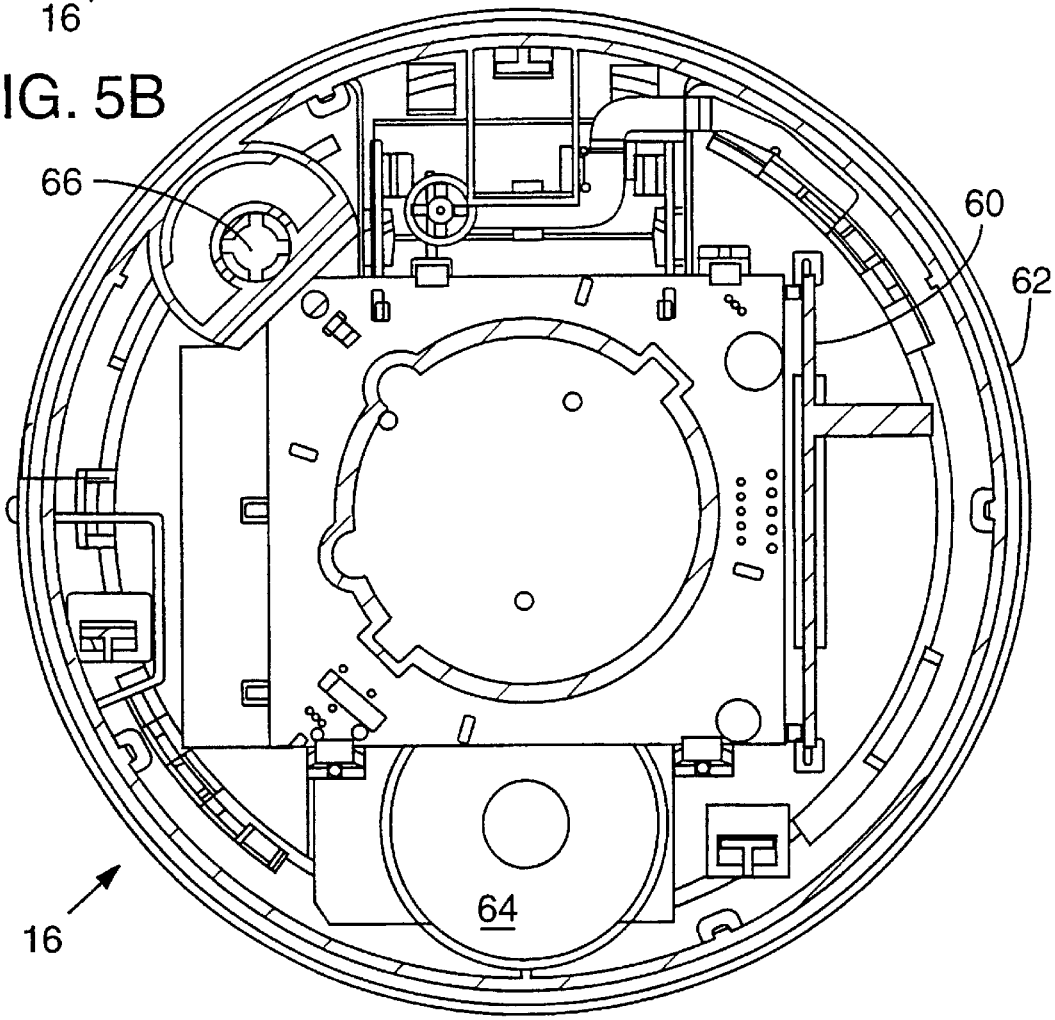

FIGS. 5A and 5B show a typical one of wireless smoke detectors 16, which are based on conventional smoke detectors with a transceiver 60 added inside a housing 62. Smoke detectors 16 preferably operate on the photoelectric principle and contain options for fixed temperature heat sensing to meet the needs of the security fire alarm systems market. Of course ionization or other types of smoke detectors can be used as well.

Smoke detectors 16 are powered by 3 AA alkaline batteries (not shown), which also power transceiver 60. Smoke detectors 16 are self-restoring devices with sounders 64 that are actuated when in an alarm mode. Sounders 64 may be silenced by depressing a "test/silence" button 66. The smoke detector electronics employ a microcontroller based architecture that includes automatic sensitivity checks to verify whether the detector is within its specified sensitivity limits. Such sensitivity checking is described in U.S. Pat. No. 5,546,074 for SMOKE DETECTOR SYSTEM WITH SELF-DIAGNOSTIC CAPABILITIES AND REPLACEABLE SMOKE INTAKE CANOPY, which is assigned to the assignee of this application. If the sensitivity changes are caused by dust and dirt, the detector automatically compensates by adjusting its sensitivity accordingly. Such automatic compensating is described in U.S. Pat. No. 5,798,701 for SELF-ADJUSTING SMOKE DETECTOR WITH SELF-DIAGNOSTIC CAPABILITIES, which is assigned to the assignee of this application. The maximum daily adjustment is 0.1%/ft. every 24 hours, with a maximum deviation of 1.0%/ft. with respect to the original factory set sensitivity. When the maximum sensitivity is reached, it will not change with further accumulation of dust. When the sensitivity drifts outside the specified limits, it visually notifies the user by extinguishing a normally flashing red LED (not shown). Smoke detectors 16 also transmit trouble and test messages to base station 12.

The photoelectric versions of smoke detectors 16 acquire ambient obscuration data every nine seconds. The red LED blinks every time a sample is taken. If any one sample is above the calibrated alarm threshold, two more samples are taken at about 4.5 second intervals. If all three samples are above the calibrated alarm threshold, the detector enters alarm condition until obscuration returns to normal, at which time the detector resets.

An optional photo/heat sensor continuously monitors ambient thermal conditions. An alarm condition is entered if the ambient temperature exceeds 57° C. independent of the rate of thermal change. A low temperature alert can also be sent when temperatures drop below 7° C., as an indication that heat has been lost in the home and potential freezing conditions are present.

As set forth in the above-described U.S. Pat. No. 5,798,701, the photoelectric detectors automatically adjust their sensitivity every 24 hours to compensate for dust build-up in the sensing chamber. The detectors adjust their sensitivity by averaging 4 samples taken every 30 minutes, and storing the minimum and maximum average taken over a 24 hour period. The closest minimum or maximum average to the clean air measurement stored during calibration is used to adjust the detectors sensitivity. The maximum adjustment allowed in a 24 hour period is 0.1%/ft. The total adjustment is limited to 1.0%/ft. for detectors becoming more sensitive, and 0.2%/ft. for detector becoming less sensitive.

When any of smoke detectors 16 enter alarm mode, the associated sounder 64 is activated. Sounders 64 in all smoke detectors 16 may be silenced by pushing "test/silence" button 66 on any of smoke detectors 16.

Smoke detectors 16 display a trouble condition by extinguishing the red LED. A trouble condition exists when any one of smoke detectors 16 fails the auto test or falls out of the specified sensitivity limits for a 24 hour period. The process for determining whether a smoke detector is out of its sensitivity range is as follows: If an obscuration sample falls outside the sensitivity limits, a 24 hour time-out begins. If at any time within this 24 hour period the smoke detector has 3 consecutive samples within the sensitivity limits, the 24 hour timer is reset.

Another trouble condition exists when any one of smoke detectors 16 detects a low battery condition. The red LED is extinguished and a "low battery" message is sent to base station 12, which begins chirping sounder 38 (FIG. 3A). If base station 12 "cancel/silence" button 40 is pushed, then the smoke detector with the low battery condition starts a trouble chirp of its sounder 64 for three minutes and then resets. Sounder 64 can be silenced by pushing "test/silence" button 66 of the smoke detector during the three minute period. If base station 12 has failed and, therefore, does not respond, then the smoke detector enters a default mode and chirps its sounder 64 to indicate a low battery condition.

Optionally, any of the sensors and other battery operated devices, such as keypads and dialers, can employ two separate low battery thresholds. One low battery threshold is set for communicating "low battery" messages through the dialer to a remote monitoring station. This message is usually sent first. A second threshold is used to signal the low battery condition locally. This allows the remote monitoring station time to set up a service call before the local low battery signal begins to sound.

Each of smoke detectors 16 is desirably fully functional for at least 30 days after a low battery condition is detected. Sounders 64 have at least an 85 dB sound intensity at 10 ft. when sounding a temporal sounding pattern, and operate nominally for at least four minutes in the alarm mode after a low battery condition is detected. Battery life is at least two years.

Referring to FIGS. 1, 4, and 5, alarm system 10 is easily end user programmable as follows:

Depressing "Enroll" button 46 on base station 12 places alarm system 10 in an enroll mode. Base station 12 selects, from among allowed frequencies, a random operating frequency, which becomes a special network frequency. Base station 12 broadcasts the system number on the special channel at full power. If another alarm system is within range and has the same system number, then base station 12 randomly selects another "special" frequency. Base station 12 reduces its transmit power level to half, to carry out enrollment, and stays awake for the entire enrollment process.

To enroll a sensor being added to alarm system 10, batteries are installed in the added sensor, which causes it to transmit to base station 12 a device type code ("DTC") message including a sensor serial number.

Base station 12 recognizes that the DTC is associated with an added sensor and returns a "teaching" message that programs the added sensor with the system configuration and a unit address. The teaching message includes an assigned frequency for the sensor, the system number, a logical device address, and an echo of the sensor serial number. Additional information can be downloaded during or after enrollment.

The added sensor confirms acceptance of this programming by chirping its sounder once.

After all of the sensors are enrolled in the system, base station 12 automatically exits "Enroll" mode after ten minutes. The homeowner can then depress "test/silence" button 66 on any of smoke detectors 16 to test alarm system 10. The smoke detector 16 initiating the system test sends a "test" message to base station 12, which responds by sending a "sound temporal pattern" message to all sensors, which activate their sounders for two minutes. The autodialer implemented in base station 12 may also send a "test signal" to the phone number programmed into the dialer.

De-enrollment is initiated by:

A specific "de-enrollment" message.

If a device fails to respond to a "find sensor" message (normally issued if the sensor misses a supervision message), base station 12 retains the missing device-information in the configuration table for one day (in case of battery change), and reports the missing device information to the central monitoring station. After the one day period, if the sensor is still missing, base station 12 de-enrolls the device and its system number will be reused. The "find sensor" message is not transmitted to devices that have reported a "low battery level 2" condition.

When changing the battery in a previously enrolled device, the device resets itself and is re-enrolled into alarm system 10. If the re-enrollment is within the one day period, base station 12 reassigns the original information to the re-enrolled device.

If base station 12 is inoperative, the sensors will sound, and the user attends to removing the batteries from all the sensors. If the batteries in base station 12 are changed in an orderly manner (this implies that the sensors receive a "base station down" message before missing a synchronization burst), the sensors will not sound, and alarm system 10 will respond normally after the batteries are replaced.

Referring also to FIG. 2, the enrollment procedure for apartments and dormitories is carried out as follows:

Each living area is assigned its own "housecode" just like installations in a home (FIG. 1). However, a "facility code" is added to the housecode to identify the apartment complex, or dormitory building. In most applications, the housecodes become a small number of digits, and the facility code becomes larger. Every sensor transmits both codes, and the receivers listen for both codes to be correct before decoding the data.

To enroll sensors in an apartment complex or dormitory building, base station 12 must first be installed. Base station 12 is manufactured with a preprogrammed pre-defined facility code. Then, when installing alarm system 10 in an apartment or dormitory room, a "hub device" for that living area must be installed first. FIG. 2 shows door/window contacts with sounders 20 being employed as the hub devices, but any device may be employed as a hub device. This is done by placing base station 12 in "enroll" mode and then inserting batteries into the selected hub device. The hub device has no pre-programmed facility or house codes and, therefore, sends a "new device" message to base station 12. Upon receipt of this new device message, base station 12 downloads the facility code, and assigns an available housecode to that hub device. Each hub device, in each living area, is assigned a different housecode. Once the hub device has its assigned facility code and housecode, the remaining devices in that living area are enrolled as explained above for a home.

Frequency assignment during enrollment of added sensors is carried out as follows:

When an added sensor has batteries installed during the enrollment process, it transmits a "new device" message to base station 12. Because base station 12 can operate on a number of available frequency channels, base station 12 may not receive the new device message if it is sent on the wrong channel. There are two possible solutions for resolving this problem. Either base station 12 automatically starts scanning all the available frequencies when placed in enroll mode until it recognizes an incoming new device message, or the added sensor transmits the new device message on the first channel, and if no answer is received within one second, the added sensor automatically transmits on the second channel. This is continued until the added sensor receives an answer back.

Once the added sensor and base station 12 link up on the same frequency, then base station 12 can download the proper operating channels and housecode, unit address, and other data to the added sensor and complete the enrollment process.

The same two-way wireless system can readily be used in commercial applications. Most of the functionality remains the same, and many of the security and fire sensors remain virtually unchanged. However, one difference is that commercial sites can cover much greater areas and distances. Therefore, data transmissions will more likely be sent through intermediary devices to reach the fringe units, and in some cases require multiple hops. The system architecture for such a large system would be very similar to the apartment or dormitory system of FIG. 2. In this case the entire commercial site would have a facility code originally supplied in base station 12. Then the system would automatically identify hub devices throughout the facility. This can be done by manufacturing some devices as unique hub devices and having them installed throughout the site, or preferably by incorporating a additional memory and processing power in each device to allow for automatic system configuration wherein any device can be assigned as a hub device.

Each hub device in the commercial system functions similarly to hub devices in the apartment or dormitory system of FIG. 2. However, rather than having a housecode, they simply have a hub code.

The typical operational interaction of base station 12 and smoke detectors 16 of alarm system 10 is summarized below in Table 1.

TABLE 1

| Event | Smoke Detector Action | Base station 12 Action |
|---|---|---|
| Fire alarm signal with alarm verification turned off | Initiating smoke detector goes into alarm and sends a signal to the base station 12 to alarm, base station 12 signals all other detectors to start their sounders. The initiating detector's red LED is latched on, all other smoke detectors LEDs are off. | If no cancel signal is received within 15 seconds, autodialer dials phone number to communicate an alarm. Before dialing, the "Alarm" LED flashes. When the dialer seizes the telephone line, the "Alarm" LED is on steady. The LED stays on until the Alarm condition is restored or the Cancel/Silence switch is pressed. Dialer reports base station 12 house/account code and fire alarm condition. |
| First fire alarm signal with alarm verification turned on | Initiating detector goes into alarm and sends a signal to the base station 12 to alarm. The base station 12 sends a reset signal to the initiating detector. | Dialer remains normal. Sends reset signal back to initiating detector |
| Second fire alarm signal from any detector within 60 seconds with alarm verification turned | Initiating detector goes into alarm and sends a signal to the base station 12 to alarm, the base station 12 signals all other detectors to start their sounders. The initiating detector's red LED is latched on, all other smoke detectors LEDs are off. | If no cancel signal is received for 15 seconds, communicator dials phone number to communicate an alarm. Before dialing the "Alarm" LED flashes and then goes solid until the Alarm condition is restored or the Cancel/Silence switch is pressed. Dialer reports base station 12 house/account code and fire alarm condition. |

TABLE 1-continued

| Event | Smoke Detector Action | Base station 12 Action |
|---|---|---|
| on Detector "Test/Cancel" button pushed during verification period or first 15 seconds of alarm | Pressed detector silences and sends silence/cancel signal to base station 12. All detectors reset after command from base station 12. | Base station 12 sends silence/cancel signal to all detectors. Base station 12 returns to normal operation |
| Base station 12 "Cancel/Silence" button pushed during verification period or first 15 seconds of alarm | All smoke detectors reset. | Base station 12 sends silence/cancel signal to all detectors. Base station 12 returns to normal operation. |
| Smoke detector button pushed after 15 second base station 12 delay | All detectors are silenced, and reset after receiving command from from base station 12. | Dialer communicates restore to central station. Base station 12 sends silence/cancel signal to detectors. |
| Initiating smoke detector clears alarm condition itself | Sends restore or cancel condition to base station 12. All detectors go silent if all detectors are clear of smoke. has been communicated. | If all units are clear, the base station 12 sends silence/cancel signal to all detectors. Sends restore signal to the central station if Alarm |
| Detector "test/cancel" button pushed during normal operation | Test signal sent to base station 12. Sounders on all detectors are energized. Sounders will automatically silence within 2 minutes. If test button is pushed again during the 2 minute period all sounders will silence. Any real fire alarm signal will override test conditions | Base station 12 sends test signal to all detectors. Base station 12 communicator dials phone number immediately without delay. Sends test signal to the central station. |
| Communication of test signal successful | N/A | Base station 12 resets to normal condition |
| Communication of test signal not successful | N/A<br>two separate numbers. | Trouble sounder on base station 12 chirps after three failed communication attempts on |
| Opening compartment door after failure of communication's test | N/A | Trouble sounder silences. Phone Line Trouble LED is energized for 10 seconds, and then resets |
| Detector drifts out of UL sensitivity range | LED on detector is extinguished. CleanMe ® signal sent to base station 12 | Trouble sounder chirps |
| Opening compartment door during CleanMe ® signal condition | Sounder in dirty detector chirps for 3 minutes and the LED blinks rapidly. | Trouble sounder silenced and "Dirty Detector" LED is energized for 10 seconds. Sounder will chirp again every 24 hours if dirty detector condition persists. |

TABLE 1-continued

| Event | Smoke Detector Action | Base station 12 Action |
|---|---|---|
| Low battery condition on a detector | LED on detector is extinguished. Low battery signal sent to base station 12. | Trouble sounder chirps. |
| Opening compartment door during low battery condition | Sounder in detector with low battery chirps for 3 minutes | Trouble sounder silenced and "Sensor Low Battery" LED energizes for 10 seconds. Sounder will chirp again every 24 hours if low battery condition persists. |
| Low battery condition on the base station 12 battery. | N/A | Trouble sounder chirps. |
| Opening compartment door during low battery condition on the base station 12 battery | N/A | "Base station 12 Low Battery" LED energized for 10 seconds and base station 12 sounder sounds steady for 10 seconds. Sounder will begin chirping again within 24 hours if low battery condition continues to exist |
| Base station 12 low battery falls to level just before inoperability. | N/A | Base station 12 dials central station to report base station 12 low battery. |
| Base station 12 "Cancel/ Silence" button pushed during telephone line trouble condition | N/A | Trouble sounder is silenced after the Cancel/Silence button is pressed. After opening the door, "Phone Line Trouble" LED is energized for 10 seconds. |
| Base station 12 fails to receive supervision signal from any detector for more than one hour. | N/A | Trouble sounder chirps. |
| Opening compartment door during system RF link trouble condition. | N/A | Trouble sounder is silenced, and "RF Link Trouble" LED is energized for 10 seconds and then extinguishes. |
| "Alarm Verification" switch "ON". | N/A | Alarm verification programming implemented in base station 12. Base station 12 will ship with this as default position. |
| "Alarm Verification" switch "OFF". | N/A | Alarm verification programing not implemented in base station 12. |
| "Enroll" button activated and batteries added to device. (This is the same process required for adding a new device or changing batteries on an | Detector begins to signal the base station 12. | When base station 12 receives signal from detector it will enroll it as the appropriate detector within the system, e.g. first signal received will be detector 1, second signal received will be detector 2 . . . etc. Base station 12 sends signal back to detector teaching the detector its identity. |

TABLE 1-continued

| Event | Smoke Detector Action | Base station 12 Action |
|---|---|---|
| existing device.) | | |
| Signal sent back to the detector from the base station 12 when in "enroll" mode. | Detector accepts programing and chirps. | N/A |
| Opening compartment door during normal conditions. | N/A | Green "System OK" LED energized for 10 seconds and then extinguishes. |
| Base station 12 idle. | N/A | All LEDs off. |
| Base station 12 batteries completely dead or base station 12 not functional and Smoke Detector initiates an Alarm. | After failure to communicate, the Smoke Detector sends an alarm message directly to other smoke detectors to turn on their Sounders. Alarm verification process is overridden. | N/A |

Figure 6:
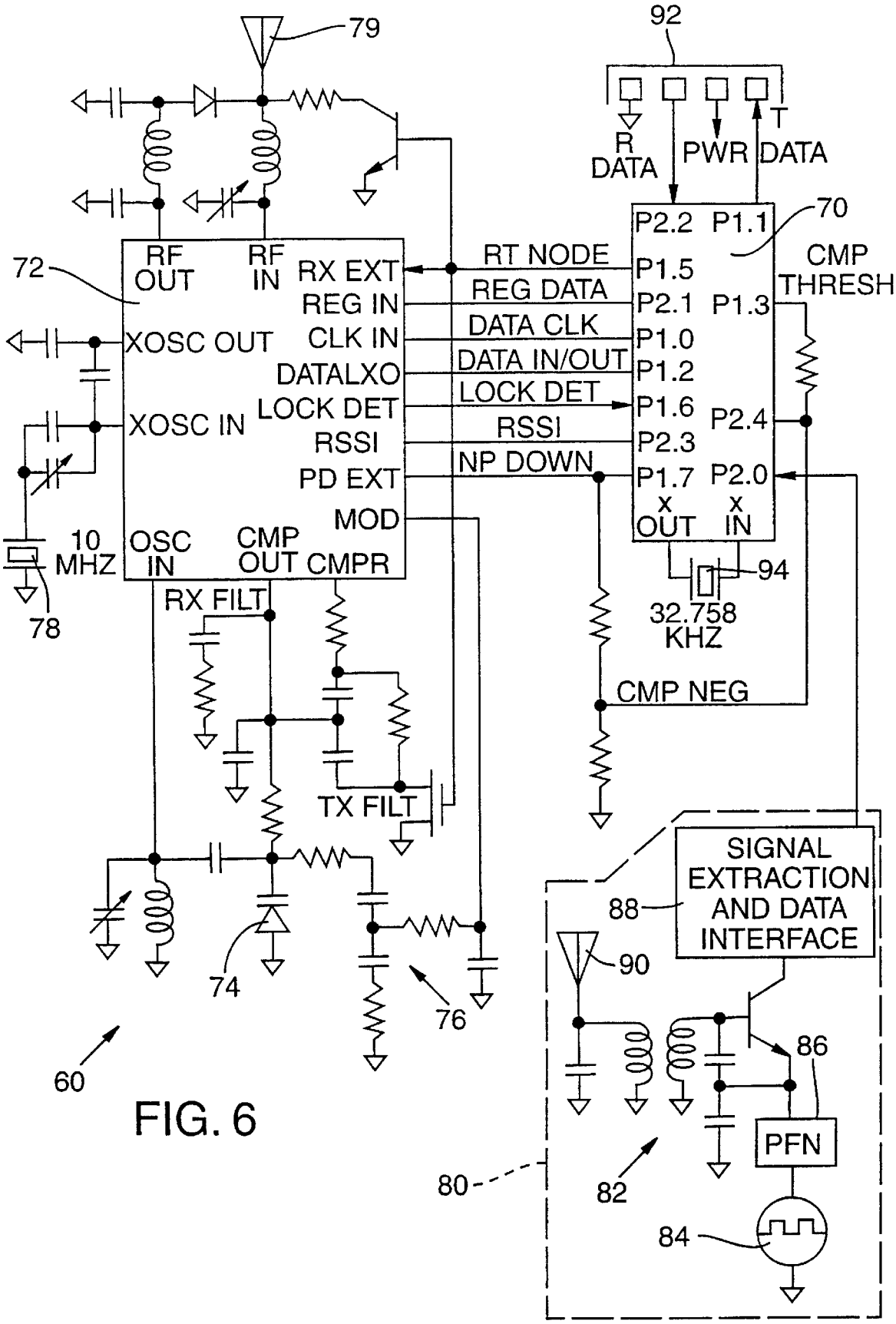
FIG. 6 is a simplified schematic electrical circuit diagram of a preferred transceiver employed in sensors, base stations, autodialers, and other devices used in the wireless fire and security systems of this invention.

Referring to FIGS. 3 and 6, alarm system 10 employs two-way wireless transceivers to avoid problems caused by deliberate or circumstantial jamming, range problems (especially in steel construction), multiple message contention, false alarms, reliability, message integrity, and power consumption. Transceivers 32 and 60 avoid jamming by automatically switching frequencies, when necessary, to an alternate channel within an FCC approved frequency band. Transceivers 32 and 60 check alarm system 10 status by periodically polling sensors and by validating and acknowledging received messages to eliminate false alarms. Transceivers 60 are configured to typically communicate directly with transceiver 32 in base station 12. However, when remote transceivers 60 are outside the range of base station 12, messages are automatically routed via any other in-range transceiver in alarm system 10.

The transceiver-based alarm systems of this invention differ from conventional wireless systems because they are interactive multi-path loop systems rather than blind broadcasts, they are two-way message transporting systems rather than one way radio nets, they have intelligence at every transporting unit instead of only at a centralized base station, and they combine local intelligence with frequency synthesized base station 12 to circumvent interference by automatically switching frequency or finding alternate pathways for sending and receiving messages. These differences are described more fully below.

A conventional broadcast communication system transmits a signal on a predetermined frequency to receivers within a given "net" area or segment. Any receiver within the "net" or segment that is tuned to the same frequency will pick up the signal. The transmitter must be sufficiently powerful to reach the furthest sensor or control, which is a battery life limitation. Moreover, the greater the range from the transmitter the greater the chance of noise corruption and interference with other systems. The sensor receivers can be made more sensitive to improve range, but this increases the occurrences of noise corruption and interference. The transmitter signal propagates "line-of-sight," so obstructions may affect it. Therefore, a broadcast system is adversely affected by relative transmitter and receiver placements and the electronic and physical environment in which it is operating.

In contrast, the intelligent transceiver system of this invention passes messages from sensors directly to base station 12, or if needed, from sensor-to-sensor to base station 12. Each sensor passes its message on with a different identifying code or unit address and with a carefully synchronized delay factor so that no two sensors broadcast at the same time. This eliminates a mutual interference, or message contention, problem. The transceiver system is designed so that each sensor delays transmitting a message until its receiver has sampled the airwaves to ensure there is no interference. Preferably this sampling occurs up to six times before triggering an automatic recovery process to reestablish contact through another route. The transceiver system functions from the sensors to the base station 12 or vice versa, attempts different routes to overcome obstructions, and dynamically reconfigures its routing to circumvent problems. The maximum communications range between low-power wireless sensors is typically about fifty meters (150 feet) indoors, and the effective range of an entire system can be up to about 2.5 kilometers depending on the number of sensors. Because each sensor requires very low power to reach its neighboring sensors, power consumption is lower compared with conventional systems that must transmit at higher power to reach longer ranges.

Conventional one way radio systems control employing a transmitter in each sensor and a receiver in the base station are relatively inexpensive to manufacture. However, when problems occur it is impossible to interrogate a sensor to check its status. Moreover, if no signal is received from a sensor, it is impossible to determine from the base station whether the sensor has encountered an obstruction or has some other problem, such as a depleted battery. Likewise, if the sensor transmits its message, it cannot determine whether the message was received by the base station. This is referred to as a "Shout and Pray" communications principle. Accordingly, messages are typically transmitted repeatedly to improve the chances of successful reception.

However, in the transceiver based alarm system 10 of this invention, a sensor transmits its message once, and repeats the message only if the first transmission is not acknowledged. This method significantly reduces the transmission time required, as well as the current consumption needed, which improves the battery life.

The intelligent transceiver architecture of this invention employs a two-way message exchange, which allows interrogation. Base station 12 routinely checks whether a sensor is active and double checks in the event of problems. The sensors also use the two-way link to confirm successful transmission of messages. Thus, the two-way message exchange provides a more reliable communication method, and it also enables passing messages from base station 12 to the sensors to provide a wider range of system monitoring functions.

Alarm system 10 includes a microprocessor in base station 12 and every sensor. The microprocessors employs this "distributed intelligence" as follows: Each sensor checks that its messages are acknowledged by base station 12. If the messages are not received, the sensor automatically reconfigures until the message is acknowledged. Each sensor reports problems, such as low batteries, by monitoring power usage and a series of other performance checks. Each sensor double checks any detected problems. Alarm conditions can be verified to reduce the number of false alarms. Transceivers can be switched on and off to minimize power consumption. Sensors can be remotely instructed to turn on or off, when the security system becomes armed or disarmed, to minimize power consumption and reduce message clutter. The sensors can be remotely instructed to carry out further functions, such as system extensions or installation of new performance requirements.

Conventional transmitters employ a fixed frequency. If noise or interference occurs on that frequency, then transmitted messages may be distorted or lost. Such interference is very common and constitutes a major cause low reliability in conventional radio systems.

Prior workers have tried to find solutions to interference and jamming problems. Some employ protocols to send each message multiple times, and others use two transmitters in each unit to redundantly transmit the message on two frequencies at the same time. However, this is an expensive and cumbersome solution that does not always work. Spread spectrum technology is sometimes seen as a practical, though expensive solution. Even if one or more of the frequencies within its spectrum is occupied at the time of message transmission, the system relies on the remaining spectrum to sufficiently transmit enough of the message to the base station. In such conventional systems, no alarms are triggered unless the base station determines that the received messages are accurate. Indeed, many systems are deliberately set so that if any doubt exists, no alarm is triggered.

However, in this invention, a sensor does not transmit a message until it has sniffed the airwaves to check for interference up to six times in a maximum of 750 milliseconds before reporting back to base station 12 that transmission is presently impossible on the present frequency. Once alarm system 10 determines that the present frequency is subject to interference, it finds another frequency that is interference free and switches all the sensors to the new frequency. By changing frequency channels when interference is detected, a much more reliable system is realized. It is also common to place a device at a location subject to multipath cancellations that prevent messages from being reliably received. Solutions to this problem include employing multiple receivers and changing frequencies.

Changing among multiple frequency bands has additional advantages. Although communications can occur between sensors and base station 12 on one frequency, this invention employs one frequency for devices, another frequency for base station 12 and, in some applications, a third frequency for the autodialer or communications to a central monitoring station. When downloading information from a remote location to alarm system 10, long messages may be sent from the autodialer to base station 12 or to a sensor that acts as a communications hub. If the long messages were communicated on the same frequency as the sensors, they would all become activated for the duration of the messages, causing unnecessary power consumption. Also, when base station 12 sends messages to the autodialer, the same unnecessary power consumption occurs. Likewise, if any device reports an alarm condition, all other devices would also receive the message, even though the message is meaningful only to base station 12.

Referring to FIG. 2, in apartment and dormitory applications, a single base station 12 in one living area transmits a message to an autodialer or to another base station 12 in another living area to pass neighbor watch type information, or to pass that information on to central monitoring station. In this application, all other devices would be required to listen to all of the messages unless different frequency channels are used.

In a meter reading application, a transceiver powered by and attached to the meter, transmits periodically, preferably once every hour, to report power consumption for variable rate billing purposes. If base station 12 employs a separate frequency for this purpose, then only base station 12 will be activated to received this periodic message, thereby conserving the battery life. In general, when messages are frequent or of a long duration, it is preferred to employ separate frequencies.

When a sensor transmits an alarm message to base station 12, a simple acknowledgment to the sensor from the base station 12 is sufficient to close the communications loop and ensure reliable transfer of critical information. There are, however, cases where this is insufficient.

Most security or fire alarm systems require that all wireless devices be supervised by base station 12 to verify that these devices are still in communication with the base station 12. Base station 12 is required to verify communications within four hours in most security systems, but as often as four minutes for some commercial fire systems.

In conventional one-way wireless security systems, each transmitter sends a packet of information that includes a supervision message that typically repeats once an hour. When the base station misses receiving four of these messages in a row, a loss of supervision is indicated. Some supervision messages are lost simply because the transmitters all send their messages at random time periods, causing some of them to clash with one another.

However, in the two-way communication system of this invention, supervision messages are communicated by a more orderly polling method. In conventional polling, the base station initiates a poll by first sniffing to verify that no other transmissions are occurring. Then a first sensor is contacted to verify its proper operation. The first sensor acknowledges, and the base station polls the second sensor, and so on. A problem with conventional polling is that the base station must individually poll each sensor, and all of the sensors remain activated for the duration of the complete polling sequence. If 16 sensors are polled, conventional polling requires 16 base station transmissions and 16 individual device acknowledgments, which requires a greater power consumption by the base station than by a sensor.

However, in a group polling method of this invention, a supervision poll request message is transmitted by base station 12 that is recognized by all sensors having a same house code as one embedded in the supervision poll request. Then, the sensors acknowledge after a predetermined time delay related to the unit address of each device. Thus device number one immediately returns an acknowledgment, followed by device number two, then device number three, etc., with each acknowledgment spaced apart in time to avoid clash problems. With the group polling method, base station 12 and the sensors each generate one transmission, thereby reducing power consumption by base station 12 and each of the devices. Group polling is further beneficial because it takes about half the time as conventional polling. To reduce time and power consumption even further, sensors need not respond back with their house code addresses, but only need to report their unit addresses because their timed transmissions confirm the correct house codes.

With group polling, if a sensor does not acknowledge a supervision poll request, base station 12 immediately interrogates that sensor to determine whether it is still active in the system. If base station 12 received no response from the sensor, it may be out of range, so base station 12 requests the other sensors to attempt contacting the nonresponding sensor to determine whether it is present. Therefore, within a few seconds, every sensor should be accounted for. A supervision poll request once every four hours achieves a higher supervision level than conventional polling once an hour from each transmitter.

With group polling, once it is determined by base station 12 that a sensor is out of range, but responds to another sensor, base station 12 stores this information and, in the future, contacts the nonresponding sensor through the intermediate sensor. For example, if sensor number 12 is out of range of base station 12, but in range of sensor number 5, base station 12 stores this information and communicates to sensor number 12 through sensor number 5. This message routing information is also stored in sensor number 12.

This communication path determining method is preferably accomplished during the initial enrollment of sensors. During the enrollment process, base station 12 contacts each sensor individually; and also contacts each sensor through other sensors until a reliable communications path has been established for each sensor. Once the paths are determined and stored in the station 12, it downloads to each sensor the best next sensor it communicate with for sending messages, thereby establishing for each sensor a primary communications path. For greater reliability, a secondary path may also be stored. This same process may be repeated whenever enrolling new sensors or if a nonresponding sensor is discovered during a supervision poll sequence.

Other types of group polling messages may also be employed, such as for fire alarms, burglary alarms, medical emergency alarms, panic/hold up alarms, trouble signals, and system arming and disarming. Are all examples of messages that can be sent to all sensors rather than requiring separate communication to each sensor. Three or four separate arming and disarming levels may be employed, such as to indicate whether a system is armed, anyone is at home, when it is armed at night and people are upstairs sleeping, and when a system is armed before an extended vacation. In each case, different sensors might respond differently, such as lights being turned on and off, motion sensors being turned on and off, and the like.

Conventional transmission based alarm systems require either manually assigning addresses for each sensor, such as with dip switches, or employ pre-set mega-addresses in the sensors that must be "learned" by the base station.

However, in the transceiver-based alarm system 10, only base station 12 is manufactured with a unique pre-set "house code," whereas the sensors have no pre-assigned addresses. When base station 12 is placed in, "enroll" mode and a new sensor is first powered up, then base station 12 recognizes this sensor as new, and downloads to the sensor the house code and a unique sensor address. This makes the enrollment process automatic, without the need for manufacturing sensors with unique codes. This method also allows for shorter sensor addresses than are required for sensors with pre-assigned addresses. Shorter addresses make for shorter, more rapid transmission times, which reduces battery consumption.

Conventional security and fire alarm systems employ control panels to enclose system intelligence, power supplies, wiring interconnections, and the autodialer.

However, the wireless system of this invention does not actually require a control panel because each sensor is battery operated, the system requires no sensor interconnections or wiring hub, the dialer may stand alone or be replaced by a cellular radio link, and intelligence can be located in any sensor or sensors.

Regarding intelligence, a control microprocessor may be located in the dialer unit of a simple fire system, or in a keypad of a security system. If the keypad is eliminated, wireless key fobs may be used for arming and disarming and the control processor, which may be located in any sensor.

Security and Fire Alarm Systems require remote monitoring. In monitored systems, wireless communications may provide a primary or back-up path for reporting alarms. Regulatory codes and standards are established to govern the minimum supervision level required to establish a reliable wireless communications link. For example, some systems require only a monthly test signal for testing the communications path. Other systems, such as monitored commercial Fire Alarm Systems, require daily supervision. Other high security applications, such as monitored security systems in jewelry stores or banks, require supervision as often as every six minutes. Such alarm systems, especially where frequent supervision is required, can be severely burdened by the supervision signals, making costs too high for some wireless technologies, and forcing alternate supervision means.

There are numerous conventional supervision techniques employed by the above monitored systems including, for example, cellular radio, dedicated long-range radio networks, two-way paging systems, dedicated lines, and Derived Communications Channels. The latter two techniques do not employ wireless communication, but are employed where high security is required. All of the above techniques, however, require regular and frequent supervision, which adds significant monitoring service costs.

A supervision technique of this invention adds frequent supervision to a wireless communications path by using cellular, GSM, or PCS technologies, at a significantly reduced cost. This invention also provides significantly improved wireless communications reliability and enables one common radio to provide low or high supervision levels without added manufacturing costs. This invention employs standard cellular radio, GSM, and PCS communications methods in a new way. When a cellular radio, or telephone is first turned on, a registration signal is sent by the radio to the nearest cell site to communicate a unique radio identification number, the radio phone number, and roaming data if the radio is outside the home area code. This information is returned to a Central Office located in the area code of the telephone to notify the Central Office that the radio is on and available for calls. The information also identifies the cell site in which the radio is located.

When the radio, or telephone, originates a call, a phone call request signal is forwarded to the Central Office where the radio is verified as a valid radio and the account is checked to ensure that the radio is authorized and paid up. If it is, a message is returned to the cell site and to the radio, opening a voice channel for placing the call.

The registration and call request signals employ special "control" channels, while the telephone call itself is communicated via different "voice" channels. The control channels send very short data bursts containing information such as radio ID, phone number, roaming data, cell site, etc. Voice channels are designed to carry much longer transmissions, such as voice and computer data.

Until recently, almost all billing charges have been based on voice channel usage. Some new technologies, such as Cellemetry and Microburst, employ the control channels to send short data messages, such as alarm or monitoring information. However, none of these technologies uses the registration signals to provide supervision.

When a cellular radio is turned on, it not only transmits a registration signal, but also regularly makes registrations thereafter at varying times, such as from every few minutes, up to 60 minute intervals. This verifies that the radio is still on and in the same cell site. Registrations stop when it is determined that the radio is no longer responding because it has been turned off, is out of range, or moved to a different cell site. The registration process is repeated if the cellular radio moves to a new cell site.

The registration process occurs continually for all cellular radios that are turned on. However, cellular service providers do not charge for registration because they are considered a required part of the rapid call placement infrastructure.

Accordingly, this invention employs registration signals to supervise the communications link with the radio. The registration signals are conveyed from the Central Office to a processor and are analyzed to verify continuous connectivity. This method, therefore, adds no extra call request demand on the cellular radio network or infrastructure yet provides improved supervision. For example, 15 to 30 minute registration intervals are common for stationary radios (more often if mobile). This is far greater than the once-a-day supervision required by commercial Fire Alarm Systems, without the need to initiate daily call requests.

Because the cellular radio initiates registration signals, such as when first turned on, the radio can be designed to generate more rapid registration signals, such as once every 5 minutes, when needed for high-security applications. This slightly increases the number of registration messages sent, but it is still well below the typical registration rates for mobile radios caused by the relatively rapid movement from cell site to cell site.

Therefore, the cellular radio is designed to generate registration messages every 5 minutes, if needed for high-security applications. When high security is not needed, the radio relies on the lower registration rates requested by cell sites.

The cellular radio requests an acknowledgment from the cell site when the registration signal is initiated by the radio and checks for the regular registration signal when it is initiated by the cell site. In this way, the cellular radio can detect when a cell site call connection is lost and generate a communication trouble signal. The trouble signal may alert people on the local premises, via audible or visual signaling means, or can be transmitted back to the Central Monitoring Station by a second telephone line or communications path if available. A second telephone line is required in commercial fire and high-security applications.

This invention is further advantageous when employed with the newer control channel data communications technologies and, in particular, with Microburst. This is because collecting registration signals from the Central Offices and forwarding them to a processing center for supervision purposes is not a simple matter when Central Offices throughout the country might be involved.

However, because Microburst Technology employs a single central office, or hub, for all Microburst radios, all registration signals and control channel data from call requests can be collected in the central office. Therefore, the registration signals are readily conveyed along with the control channel data to a processing center for supervision.

If the processing center detects a loss of supervision of registration signals, this information is conveyed to a monitoring center for notification of the proper authorities.

Skilled workers will recognize that this communication in supervision technique is useful for other applications, such as meter reading, vending machine monitoring, and mobile vehicle tracking.

Employing transceivers 32 and 60 and communications protocols of this invention allow wireless alarm system 10 to match the performance of wired alarm systems while providing the advantages of simple installation, low cost, improved in-service performance, higher reliability, and added user benefits.

FIG. 6 shows transceiver 60, which is preferred for use not only in sensors, but in place of transceiver 32 in base station 12 because it enables implementing an micro-power, asynchronous, two-way, radio frequency data network with a special wake-up protocol. Transceiver 60 can also be applied for point to point radio frequency communications for extending battery life, such as in cordless phones and wireless keypads.

Transceiver 60 overcomes the many constraints to extending battery life and maintaining reliable radio data communication under a network condition. Transceiver 60 includes a microprocessor 70, which is preferably a Texas Instruments MPS430 ultra-low power processor with on-chip memories. An additional non-volatile memory may be required for storing personalized network information.

Transceiver 60 further includes a transceiver chip 72 that integrates most circuitry for a local oscillator, phase locked loop, in-channel and quadrature-channel data paths, RF and IF filters, and a base band control circuit. Transceiver chip 72 is preferably a type number NOVA3.3 available from Gran-Jansen of Oslo, Norway. Transceiver chip 72 communicates serially with microprocessor 70 to select sleep, receive, and transmit modes; transfer control data; transfer receive and transmit data; and setup and phase-lock associated frequencies. A varicap 74 receives modulation data through a filter network 76 to frequency shift key ("FSK") modulate data in transmit mode.

Transceiver chip 72 employs a stable 10 MHZ crystal 78 and digitally synthesizes frequencies under shared phase-lock control with microprocessor 70. Transceiver chip 72 need not have a fast wake-up time nor particularly low power consumption because it is in sleep mode a majority of the time. An antenna 79 is coupled through resonant circuits to the RF in and out pins of transceiver chip 72.

Transceiver 60 also includes a superregenerative micro-power receiver 80 that incorporates a sampling mixer. Micro-power receiver 80 draws only about one to six microamperes of current during sleep mode and includes a Colpitts oscillator 82, a quench oscillator 84, a pulse-forming network 86, a signal extraction network and data interface 88, and an antenna 90. Alternatively, micro-power receiver 80 may be coupled to antenna 79. A suitable implementation of micro-power receiver 80 is described in U.S. Pat. No. 5,630,216 for MICROPOWER RF TRANSPONDER WITH SUPERREGENERATIVE RECEIVER AND RF RECEIVER WITH SAMPLING MIXER, which is incorporated herein by reference.

Battery power for transceiver 60 is received through a connector 92 that also transfers receive and transmit data with the sensor or control unit in which it is installed. Monitoring battery condition is an important function that is carried out during every message transmission (the highest current drain condition) by transceiver chip 72 to ensure reliable sensor or base station 12 operation.

Microprocessor 70 includes a digitally controlled oscillator ("DCO"), a predetermined frequency of which decreases as the battery voltage decreases. A reference frequency is established by a stable 32.768 KHz crystal resonator 94. Comparing the DCO predetermined frequency to the reference frequency provides a means for monitoring the battery voltage.

Microprocessor 70 performs numerous functions including decoding a specially coded "wake up" message received from micro-power receiver 80; formatting and Manchester encoding data during transmit mode; performing frame, packet, byte, symbol, and bit synchronization; performing received signal strength measurement during receive mode; and controlling media access layer and logical link layer protocols.

The media access layer control includes sleep/wake-up cycle control, data collision control and media access layer acknowledgment. The key media access method employs a combination of an ALOHA protocol approach during wake-up sequences and carrier sense multiple access/collision avoidance ("CSMA/CA") after wake-up sequences.

The logical link control includes device addressing; packet structure; packet error control; and network layer functions, such as RF channel control, packet routing, routing table management, and supporting mobile devices for roaming in and out of the coverage area. Microprocessor 70 can receive external triggers in sleep mode, and passes all the data associated with high layer protocols to a processing unit in the associated sensor or base station 12.

To achieve reliable two-way communication through a wireless data network, periodic synchronization of the network must be accompanied by a quick network response. This is difficult to achieve in networks in which all the sensors and base station 12 are battery powered. Features such as packet routing, channel switching (to avoid RF interference and jamming) and roaming for mobile devices (i.e., the device is out of reach of the network during normal operation) place additional demands on the battery capacity and add complexity to the communication protocols. Moreover, with some communication protocols, the need for fast transceiver wake-up and low power operation make the transceiver design challenging.

The above-described communication protocol employs a low duty cycle of message transmitting time compared to the standby time. Accordingly, the network is in a sleep mode most of the time. Unfortunately, this makes network synchronization difficult. Therefore, transceiver 60 employs the following cascaded wake-up communication protocol.

When no messages are being transmitted, all sensors and base station 12 are in an ultra low power sleep mode. During sleep mode, micro-power receiver 80 monitors a predetermined frequency, preferably 418 MHZ in the United States and 433 MHZ in Europe. Micro-power receiver 80 can be very simple because it is not required for data communication, only for receiving the "wake-up" message.

Whenever any of the sensors or base station 12 need to send a message, its transceiver chip 72 first transmits the wake-up message.

All other sensors and base station 12 receive and decode the wake up message via their micro-power receivers 80, which in turn wakes up microprocessor 70 to redundantly decode the wake-up message to determine whether to activate transceiver chip 72. If a wake-up message is definitely received, microprocessor 70 deactivates micro-power receiver 80 and activates transceiver chip 72.

After the sensor sends the wake-up message, it transmits a synchronization sequence, to synchronize the other transceivers in alarm system 10.

Following the synchronization sequence, a data message can be transmitted to an individual address or broadcast to a group addressed devices.

A confirmation message is returned by the addressed device or devices.

Upon completing communications, all sensors and base station 12 return to the sleep mode to extend battery life.

To implement the wake-up message, transceiver 60 emulates a low speed amplitude-shift keyed transmission. All transceivers employ the same predetermined frequency for transmitting and receiving wake-up messages. Emulating the low speed transmission requires switching the transmitter on and off at a controlled rate, preferably less than 1 KHz, which limits the wake-up message bit rate to less than 1 kilobit per second. Slower speeds can be employed as long as micro-power receiver 80 can reliably decode the wake-up message. Microprocessor 70 requires a fast wake-up time, preferably less than a few microseconds, to properly process the wake up message. The wake-up message includes the system number to determine which systems are to wake up.

To implement the data communication protocols, transceiver 60 switches to a 19.2 kilobaud, Manchester coded, FSK mode for transmitting and receiving data. Data communication frequencies are readily switchable among numerous channels in a 400 MHZ range or a 800 MHZ range. The preferred channel bandwidth is 60 KHz and the channel spacing is 120 KHz to avoid adjacent channel interference. Before each data transmission, a series of Manchester zero codes are transmitted to ensure communication frame synchronization. Packet start and end sync words inserted to enable packet synchronization. Byte synchronization is employed to avoid sampling clock drift problems. Element/bit synchronization is achieved by recovering the sampling clock frequency from the sequence of Manchester coded zeros. The communication protocol operates in half-duplex mode.

The wake-up protocol enables using a very simple medium access control method with no regular system synchronization being necessary. Preferred medium access control parameters are described below.

The wake up message is the same for all systems and is transmitted on a predetermined frequency.

The wake up message is one way only and is transmitted by any device that awakens from sleep mode to transmit a data message.

Normal half-duplex data communication is carried out on a frequency that is established during system set up, log on, or during enrollment.

After any of the sensors or base station 12 awakens, it shall not listen for a further wake up message.

Each data message, transmitted after the wake up message contains a frame synchronization preamble comprising a series of Manchester coded zeros.

All data messages are acknowledged by the addressed device.

If the acknowledgment is missing, an RF message collision is assumed. A retransmission is attempted at least three times or until a valid acknowledgment is received.

Any sensor or base station can transmit a data message after the first data message, but it must first listen to ensure the channel is clear before switching from receive to transmit mode.

Transceivers wait in receiving mode until the channel is clear.

To avoid further RF collisions, a random delay is applied before attempting a re-transmission.

Sensors and control units return to sleep mode after sensing a clear RF channel for a predetermined time.

The following alternative communication protocol is preferred when employing transceiver 32 or transceiver 60 without micro-power receiver 80. The alternative protocol employs half duplex, Manchester coded, FSK data communication at 19200 kilobaud, eight frequency channels for either US or European markets, and a reserved frequency for one-way transmitting devices, such as for transmitting the wake-up message. The frequency spacing is 200 KHz.

A combination of frequency division multiple access and time division multiple access communication methods are employed. Alarm system 10 communication synchronization employs a deterministic non-contention technique in which base station 12 synchronizes the system every 60 during a one second active time interval. Cross system contention is possible if two systems are using the same RF channel. If a collision occurs, base station 12 sets a random number between 30 and 60 seconds for the next system synchronization. Up to 30 systems can co-exist on a single RF frequency with a 33 millisecond time slot for each system. The systems uses CSMA/CA protocol to reduce collisions during half duplex operation. Each message is acknowledged by its addressed recipient, which serves as a basis for collision detection.

Cross system communication is possible if two base stations are within communication range. The special RF channel is used for cross system communication, so each base station must monitor its own frequency and the special frequency during every wake-up time period. One hundred systems may co-exist within one RF range, which is typically 100 meters in free space and 50 meters indoors. Accordingly, any sensor can transmit a "find base station" message if does not detect its own base station during a predetermined time interval.

Transceivers 32 and 60 can relay messages to three other transceivers that are outside the range of base station 12.

Up to 32 transceivers may be assigned to an addressable group, and 32 groups are assignable.

The following communication protocol is employed to ensure system synchronization and minimize collisions.

Each sensor is monitoring its own pre-assigned frequency, and base station 12 monitors both its own assigned frequency and the special frequency.

Alarm system 10 is awakened once each second to listen for any possible messages or extraneous radio-frequency activity.

A preferred wake up sequence for transceiver 60 is: microprocessor 70 awakens and activates transceiver chip 72. Transceiver 60 then performs oscillator and phase-locked loop stabilization and lock. Once locked, transceiver 60 cycles through a number of 104 microsecond time slots for performing respective, frequency monitoring, base station 12 detection, odd numbered logical address detection, even numbered logical address detection, frequency monitoring, and returning back to sleep mode.

After monitoring its own assigned frequency, base station 12 sends an 82-bit control word to its transceiver chip 72 to switch to the special frequency. After frequency locking, transceiver chip 72 monitors the special frequency for 520 microseconds before receiving another 82-bit control word for switching to the next active time slot before returning to sleep mode.

An "acknowledgment" message is transmitted within one millisecond by a transceiver in response to receiving any message from another transceiver. If the acknowledgment is missing, a message collision or jamming is assumed. Three retransmissions are attempted before transceiver 60 reports the missing acknowledgment to its local host processor. Acknowledgments have the highest processing priority.

Time slot synchronization is carried out once per minute by base station 12 transmitting a five millisecond synchronization burst. Each sensor wakes-up 33 milliseconds. If any sensor is not correctly time synchronized and, consequently misses the synchronization burst, its next wake-up time slot is begins five milliseconds earlier and ends five milliseconds later. If the sensor misses three successive synchronization bursts, this fact is reported to its local host processor, and the sensor transmits a "find base station" message.

Alternatively, the synchronization burst may be transmitted more often, for example, once every two to ten seconds to provide tightly synchronized communications among devices. However, this causes increased power consumption and communications traffic.

The synchronization burst may also be transmitted less often, for instance once per hour, which is the time period for normal application supervision. This reduces power consumption and communications traffic, but a very long synchronization burst may be required.

Data messages transmitted in alarm system 10 are acknowledged by the receiving device transmitting an "application acknowledgment" message. The addressed and acknowledging devices stay awake, and the other devices return to sleep mode.

Alarm system 10 further performs two network service functions. One is determining message routing when it is necessary to relay a message from a transmitting device, through at least one intervening device, to a message receiving device. The other function is establishing cross system communications under special alarm conditions, such as when base station 12 is inoperative.

Message routing requires flexibility because there are a number of factors affecting communications, such as: moving a device; modifying building construction or moving furnishing and, thereby, causing multi-path signals that weaken reception; or introducing a source of interference.

Message routing employs a automated Pathfinder® protocol that accounts for the above changing communications environment. The Pathfinder® protocol employs setup, operation, and reset phases.

In the Pathfinder® setup phase, each device expects a supervision poll from base station 12, or another domain controller, every hour or 72 minutes. For the synchronous data network embodiment, a network devices expect a synchronization burst every minute. These regular communications could be missed because of degraded communications conditions. Under such circumstances, the affected device broadcasts a "find base station" command. Any other devices in the same network can accept this command and relay the message to base station 12 and reply to the initiating device. The initiating device thereby learns that it is not directly communicating with base station 12.

Once base station 12 receives the "find base station" message, it creates a routing; table and nominates a suitable router or routers for communicating with the initiating net device. The routing pathway will be one of the relay pathways taken by the "find base station" message. Base station 12 determines the easiest and most reliable path stored in the existing network configuration and routing tables.

Once a routing pathway has been established, base station 12 downloads the routing table to the router(s). The routing table includes the unit address of each device and a group number.

The Pathfinder® operation phase proceeds as follows: Once a device has a non-empty routing table, it takes on the added function of a router. Messages between base station 12 and final designated devices have the same structure (source address and destination address, or group number) as a broadcast message. The router determines whether to relay or discard a message.

When a device receives a message, it checks the destination address to determine whether the message requires routing. If the destination address does not matches its own unit address, the device checks its routing table unit addresses, and if a match is found, the router relays the message without modification.

For a broadcast message, the router examines the group number against the routing table regardless of its own group number status. The message is relayed without modification if a match is found in the routing table.

If the destination address is the base station address, the source device address is checked against the routing table. If a match is found, the message is relayed without any changes.

Messages from base station 12 to the final designated devices or vice versa are preserved during relay operations and are "transparent" to ensure the correct source and destination unit addresses.

Pathfinder® reset phase operates as follows: Base station 12 may receive multiple replies from a final designated device including a very fast message acknowledgment from the device. This indicates that direct communication is possible. Base station 12 can then download an updated routing table to the previously defined router(s) or clear items in the routing tables. This changes the routing pathways and resets the previous router.

There are many advantages to the two-way wireless alarm system described herein versus prior one-way wireless alarm systems.

When an alarm is detected by any sensor, all sensors sound the alarm so it can be heard throughout the house.

To silence a fire alarm, pressing the "Silence" button on any smoke detector silences all the sounders.

To set up and test this two-way system, a user presses the "Enroll" button on the base station 12, and places batteries into each sensor. Then, pressing one of the "Test" buttons tests the whole system.

Adding a two-way security system to an existing fire system only requires adding a two-way wireless keypad and two-way wireless security sensors in communication with the keypad. The keypad then reports through the autodialer.

The cost of a one-way smoke detector is less than the cost of a two-way smoke detector. However, the cost of a one-way base station is higher than the cost of two-way base station 12 because a dual diversity receiver is required in the one-way unit to provide reliable reception. Moreover, the receiver must operate continuously, thereby requiring an AC power adapter, a voltage regulator, added lightning protection, and back-up batteries.

Because an AC power adapter is needed for a one-way system, the homeowner will be required to connect the base station to an unswitchable AC power source, which is not always close to a telephone jack.

In the two-way system, transmission range is not limited by the distance between the base station 12 and the most distant sensor because messages are relayed from sensor to sensor.

In the two-way system, during trouble conditions, such as a low battery or dirty detector, such trouble conditions are indicated only at base station 12 until its door is opened, at which time base station 12 signals the appropriate detector to indicate its trouble condition.

Communications reliability is higher in a two-way system because sensors receive acknowledgment that alarm messages have been received, or the system can retry message transmission on multiple frequencies, or via alternate paths, until an acknowledgment is received.

Complete elimination of wires is possible in a two-way wireless system, enabling much easier and quicker installations and requiring less technical aptitude and training to complete.

Of course, one-way communications may be employed in selected low-cost sensors to suit particular application requirements.

It will be obvious to those having skill in the art that many changes may be made to the details of the above-described embodiments of this invention without departing from the underlying principles thereof. Accordingly, it will be appreciated that this invention is also applicable to wireless control applications other than those found in alarm systems. The scope of this invention should, therefore, be determined only by the following claims.

What is claimed is:

1. A method of automatically programming a wireless sense and/or control system to enroll one or more sensor devices distributed at different locations throughout a spatial region, comprising:

providing a two-way wireless communication capability between a base station having a base station transceiver and at least one of the sensor devices having a sensor device transceiver;

initiating an enroll condition in the base station to place the system in a sensor device enroll mode;

introducing a trigger event to a sensor device and delivering from the sensor device transceiver to the base station transceiver in response to the trigger event a new device message signal identifying the sensor device;

delivering from the base station transceiver to the sensor device transceiver in response to the new device message signal a programming signal indicating a sensor device address; and storing the sensor device address in the sensor device.

2. The method of claim 1 in which the programming signal further comprises system configuration information that includes one or more of sensor device addresses of other sensor devices in the system, a signal transmission frequency, and communication pathway information relating to communication between the base station and any of the sensor devices enrolled in the system.

3. The method of claim 1 in which the sensor device is out of direct communication range with the base station, and further comprising an intervening sensor device having an intervening sensor device transceiver positioned to receive from the sensor device and transmit to the base station the new device message signal and to receive from the base station and transmit to the sensor device the programming signal.

4. The method of claim 3 in which the spatial region comprises a multi-dwelling complex, the base station is installed in communication with the multiple dwelling complex, and the sensor devices are installed in individual dwelling locations.

5. The method of claim 1 in which the introducing a trigger event to a sensor device comprises installing a battery in the sensor device.

6. The method of claim 1 in which the base station is battery powered.

7. A low power sense and/or control system implemented with wireless two-way communication capability in a communication medium between a base station and one or more of multiple sensor devices distributed at different locations throughout a spatial region, comprising:

multiple sensor devices each having a different identification address and a sensor device transceiver that transmits a communication message signal in response to a wake-up producing condition, the sensor device transceiver including low power-consuming sensor signal processing circuitry and sensor signal communication circuitry selectively switchable between a lower power-consuming standby mode and a higher power-consuming operating mode, and the sensor signal processing circuitry storing in memory sites different control signals corresponding to different communication message signal producing conditions; and a base station having a base station transceiver including base station signal processing circuitry and base station signal communication circuitry, the base station signal processing circuitry cooperating with the base station signal communication circuitry to receive the communication message signal and transmit in response to it an activation signal to which the sensor device transceiver of the sensor device that transmitted the communication message signal can respond to produce a control signal corresponding to the communication message signal producing condition, and the base station receiving from the sensor device transceiver that transmitted the communication message signal a supervision message that includes the identification address to verify a communication link between them.

8. The system of claim 7 in which the base station signal communication circuitry is selectively switchable between a lower power-consuming standby mode and a higher power-consuming operating mode and in which the base station further comprises a micro-power receiver in operative association with the base station transceiver, the micro-power receiver communicating with the base station transceiver such that, in response to detection by the micro-power receiver of the communication message signal, the base station signal communication circuitry assumes its operating mode to enable the base station transceiver to decode the communication message signal and transmit the activation signal to the sensor device that transmitted the communication message signal.

9. The system of claim 8 in which each of the multiple sensor devices further comprises a micro-power receiver in operative association with the sensor transceiver, the micro-power receiver communicating with the sensor transceiver such that, in response to detection by the micro-power receiver of the communication message signal, the sensor transceiver assumes its operating mode to receive the activation signals.

10. The system of claim 8 in which, after the base station signal communication circuitry assumes its operating mode, the base station transceiver receives a portion of the communication message signal to confirm that the signal detected by the micro-power receiver is a valid communication message signal.

11. The system of claim 8 in which the base station transceiver transmits the control signal to multiple sensor devices in addition to the sensor device that transmitted the communication message signal to provide at different locations in the spatial region the control signal of the communication message signal producing condition.

12. The system of claim 7 further comprising an automatic telephone dialer that is operatively connected to the base station for communicating with a monitoring center in response to at least one of a test condition, a trouble condition, an alarm condition, a sensor device supervising process, a base station-to-monitoring center supervising process, a verification process, or a status indicating condition.

13. The system of claim 7 in which one of the multiple sensor devices is an out-of-range sensor device that is out of direct communication range with the base station, and further comprising an intervening sensor device having an intervening sensor device transceiver positioned to receive from the out-of-range sensor device and transmit to the base station the communication message signal and to receive from the base station and transmit to the out-of-range sensor device the activation signal.

14. The system of claim 7 in which the base station signal communication circuitry is selectively switchable between a lower power-consuming standby mode and a higher power-consuming operating mode and the base station signal communication circuitry assumes its operating mode during a time when the sensor device transmits the communication message signal to receive the communication message signal and transmits in response to it an activation signal to which the sensor device transceiver of the sensor device that transmitted the communication message signal can respond to produce a control signal corresponding to the communication message signal producing condition.

15. The system of claim 7 in which the base station transceiver continually transmits synchronization signals and in which the sensor signal communication circuitry of each of multiple sensor devices continually switches between the standby and operating modes to sample the communication medium for transmission of the synchronization signals and thereby enable the sensor device transceiver in its operating mode to receive the synchronization signals, to thereby enable synchronization of the switching between the standby and operating modes of the multiple sensor devices.

16. The system of claim 7 in which the sensor signal processing circuitry of each of the multiple sensor devices establishes a transmission time at which the communication message signal is transmitted, the transmission time of any one of the multiple sensor devices being different from the transmission time of any other one of the multiple sensor devices.

17. The system of claim 16 in which the transmission time of any one of the multiple sensor devices is determined by the identification address of the sensor device.

18. The system of claim 8 in which the base station transceiver transmits the control signal to multiple sensor devices in addition to the sensor device that transmitted the communication message signal to provide at different locations in the spatial region the control signal of the communication message signal producing condition.

19. The system of claim 7 in which the communication message signal producing condition includes a test condition, a trouble condition, an alarm condition, an enrollment process, a supervising process, a verification process, a status indicating condition, a sound-controlling condition, a sensor arming condition, a sensor disarming condition, an indicator light controlling condition, a switch controlling condition, a communication message signal acknowledgment condition, a system configuration indicating condition, or a message routing condition.

20. The system of claim 7 in which the base station is battery powered.

21. The system of claim 7 in which the multiple sensor devices further comprise associated sounders and at least one of the multiple sensor devices transmits a communication message signal indicating an alarm condition, and in which the base station responds to the alarm condition message by transmitting a sounder activating message signal to the multiple sensor devices to sound their associated sounders.

22. The system of claim 21 in which the multiple sensor devices are of a smoke detector type or a fire detector type.

23. The system of claim 21 in which the alarm condition message is a smoke or fire alarm condition message and in which the base station responds to the smoke or fire alarm condition message by transmitting a message resetting the sensor device that transmitted the smoke or fire alarm condition message, and waiting a predetermined time period to determine whether at least one additional occurrence of the smoke or fire alarm condition message is received from any of the multiple sensor devices before transmitting the sounder activating message.

24. The system of claim 21 in which the multiple sensor devices are of a smoke detector type or a fire detector type and in which the base station and each of the multiple sensor devices includes a manually operable button for initiating a silence message that is transmitted throughout the spatial region to silence the sounders.

25. The system of claim 7 in which the multiple sensor devices further comprise associated sounders and one of the sensor devices transmits a communication message signal indicating an alarm condition that the base station fails to acknowledge, the one of the sensor devices responding by transmitting a sounder activating message signal directly to the multiple sensor devices to sound their associated sounders.

26. The system of claim 7 in which the multiple sensor devices are fire, smoke, or intrusion sensor devices that further comprise associated speakers and in which one of the multiple sensor devices transmits an alarm condition message signal to which the base station responds by transmitting a speaker activating message instructing the multiple sensor devices to vocally announce a location of the sensor transmitting the alarm condition message and whether the alarm condition is a fire, smoke, or intrusion alarm condition.

27. A method of automatically programming a wireless sense and/or control system to enroll one or more sensor devices distributed at different locations throughout a spatial region, comprising:

providing a two-way wireless communication capability between a base station having a base station transceiver, an intervening sensor device having an intervening sensor device transceiver, and at least one of the sensor devices having a sensor device transceiver that is out of direct communication range with the base station;

initiating an enroll condition in the base station to place the system in a sensor device enroll mode;

introducing a trigger event to the sensor device and delivering from the sensor device transceiver, through the intervening device transceiver, to the base station transceiver in response to the trigger event a new device message signal identifying the sensor device;

delivering from the base station transceiver, through the intervening device transceiver, to the sensor device transceiver in response to the new device message signal a programming signal indicating a sensor device address; and storing the sensor device address in the sensor device.

28. The method of claim 27 in which the programming signal further comprises system configuration information that includes one or more of sensor device addresses of other sensor devices in the system, a signal transmission frequency, and communication pathway information relating to communication between the base station and any of the sensor devices enrolled in the system.

29. The method of claim 27 in which the spatial region comprises a multi-dwelling complex, the base station is installed in communication with the multiple dwelling complex, and the sensor devices are installed in individual dwelling locations.

30. The method of claim 27 in which the introducing a trigger event to a sensor device comprises installing a battery in the sensor device.

31. The method of claim 27 in which the base station is battery powered.

* * * * *